United States Patent [19]

Morigaki et al.

[11] Patent Number: 4,929,538

[45] Date of Patent: May 29, 1990

[54] SILVER HALIDE COLOR PHOTOGRAPHIC MATERIAL

[75] Inventors: Masakazu Morigaki; Kozo Aoki, both of Kanagawa, Japan

[73] Assignee: Fuji Photo Film Co., Ltd., Kanagawa, Japan

[21] Appl. No.: 102,511

[22] Filed: Sep. 29, 1987

[30] Foreign Application Priority Data

Sep. 29, 1986 [JP] Japan ..... 61-230854

[51] Int. Cl.[5] ..... G03C 1/34; G03C 7/34

[52] U.S. Cl. ..... 430/551; 430/552; 430/553; 430/558

[58] Field of Search ..... 430/551, 552, 553, 558

[56] References Cited

U.S. PATENT DOCUMENTS

| | | | |
|---|---|---|---|
| 4,526,864 | 7/1985 | Takada et al. | 430/552 |
| 4,666,826 | 5/1987 | Takada et al. | 430/551 |
| 4,745,050 | 5/1988 | Seto et al. | 430/551 |
| 4,746,602 | 5/1988 | Oro et al. | 430/549 |
| 4,748,100 | 5/1988 | Umemoto et al. | 430/505 |

FOREIGN PATENT DOCUMENTS

| | | | |
|---|---|---|---|
| 0164030 | 12/1985 | European Pat. Off. | 430/553 |
| 0171953 | 9/1984 | Japan | 430/553 |
| 1114239 | 5/1986 | Japan | 430/553 |
| 2087961 | 4/1987 | Japan | 430/552 |
| 2173466 | 7/1987 | Japan | 430/553 |
| 2178258 | 8/1987 | Japan | 430/551 |
| 2178962 | 8/1987 | Japan | 430/551 |
| 2198859 | 9/1987 | Japan | 430/553 |
| 2210465 | 9/1987 | Japan | 430/553 |
| 2171215 | 8/1986 | United Kingdom | 430/552 |

*Primary Examiner*—Roland E. Martin
*Assistant Examiner*—Lee C. Wright
*Attorney, Agent, or Firm*—Sughrue, Mion, Zinn, Macpeak & Seas

[57] ABSTRACT

A novel silver halide color photographic material is provided, containing at least one coupler represented by formula (C-I) and at least one compound represented by formula (A-I) or (A-II)

(C-I)

wherein $Q_1$ represents an atomic group containing at least one nitrogen atom required to form a 5- or more membered nitrogen-containing heterocyclic ring together with the carbon atoms to which it is bonded; $Z_1$ represents a hydrogen atom or a coupling-off group; $R_{C1}$ represents an acyl or sulfonyl group; and $R_{C2}$ represents a hydrogen atom or a $C_{1-8}$ aliphatic group, or the substituents for $R_{C1}$, $R_{C2}$, $Z_1$, or $Q_1$ form a dimeric or polymeric coupler;

(A-I)

(A-II)

wherein R represents a hydrogen atom, an aliphatic group, an aromatic group, a heterocyclic group, or a hydrolyzable protective group; $R_1$, $R_2$, $R_3$, $R_4$, and $R_5$ each represents a hydrogen atom or a substituent; R' represents a hydrogen atom, an aliphatic group, an acyl group, a sulfonyl group, a sulfinyl group, an oxyradical group or a hydroxyl group; A represents a non-metallic atomic group required to form a 5-, 6- or 7-membered ring; and $R_6$, $R_7$, $R_8$, and $R_9$ each represents a hydrogen atom or an alkyl group, or the substituents represented by R and $R_1$ or two or $R_1$, $R_2$, $R_3$, $R_4$, and $R_5$ in formula (A-I) which are in an ortho-position relation are bonded to each other to form a 5-, 6-, or 7-membered ring, or the substituents represented by $R_6$ and $R_7$, $R_8$ and $R_9$, or R' and $R_6$ in formula (A-II) are bonded to each other to form a 5-, 6-, or 7-membered ring.

21 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material comprising a nitrogen-containing heterocyclic condensed cyan coupler capable of providing dyes of improved fastness.

BACKGROUND OF THE INVENTION

When an exposed silver halide photographic material is subjected to color development, a developing agent such as aromatic primary amine which has been oxidized by silver halide reacts with a dye-forming coupler to form a color image. This color development is normally accomplished by the subtractive color reproduction process. In this process, the reproduction of blue, green, and red is effected by forming color images of yellow, magenta, and cyan, which are complementary to blue, green, and cyan, respectively.

As cyan-dye-forming couplers, phenolic and naphtholic types have been used. However, the stability of color image obtained from such conventional phenolic and naphtholic couplers leaves to be desired. For example, a color image obtained from a 2-acylaminophenol cyan-dye-forming coupler (also referred to herein more simply as a "cyan coupler") as described in U.S. Pat. Nos. 2,367,531, 2,369,929, 2,423,730 and 2,801,171 is generally poor in fastness to heat. a color image obtained from a 2,5-diacylaminophenol cyan coupler as described in U.S. Pat. Nos. 2,772,162 and 2,895,826 is generally poor in fastness to light. 1-Hydroxy-2-naphthamide cyan coupler generally leaves much to be desired in fastness both to heat (moist heat) and light.

In recent years, nitrogen-containing heterocyclic condensed cyan couplers as represented by formula (C-I) of the present invention have been found to eliminate the above-mentioned shortcomings of cyan-dye-forming couplers. These couplers are excellent in fastness to heat and light as compared to the prior art couplers.

However, it was found from the inventors' extensive studies that these nitrogen-containing heterocyclic condensed cyan couplers leave much to be desired in the stability of color images formed in a color light-sensitive material as compared to yellow or magenta couplers.

Such a deterioration of image quality is a serious defect in a recording material.

Heretofore, studies have been made to develop various dye stabilizers for magenta couplers to inhibit such a deterioration of image quality. Examples of such dye stabilizers for magenta couplers include hydroquinones, 6-hydroxychromans, 5-hydroxycoumarans, spirochromans, spiroindans, p-alkoxyphenols, hindered phenols such as bisphenols, gallic acid derivatives, methylenedioxybenzenes, aminophenols, hindered amines, and ether or ester derivatives obtained by silylating, acylating or alkylating phenolic hydroxyl groups thereof. Metal complexes are known as such dye stabilizers.

However, these dye stabilizers are not always sufficiently effective for the stability of cyan images even though these are effective for magenta images. Some dye stabilizers worsen the preservative stability.

On the other hand, it has been known that an ultraviolet absorber or a combination of certain types of high boiling organic solvents (Japanese Patent Publication Nos. 15380/82 and 45014/83, and Japanese Patent Application (OPI) No. 99432/79 (the term "OPI" as used herein refers to a "published unexamined Japanese patent application")), certain phenol compounds (Japanese Patent Application (OPI) Nos. 48535/79, 3432/84, 124340/84, 222853/85 and 86750/86), hindered amine compounds (U.S. Pat. No. 4,268,593, and Japanese Patent Application (OPI) Nos. 114036/83, 124340/84 and 222853/85), ester compounds (Japanese Patent Application (OPI) No. 3433/84), and ether compounds (Japanese Patent Application (OPI) Nos. 77527/78 and 11453/71) is used for the purpose of improving the stability of cyan images.

It is true that these compounds are effective for resisting the deterioration or discoloration of dye images. However, such an effect is sometimes small. Some compounds are effective for inhibition of discoloration, but can deteriorate color hue or cause fog, poor dispersion, or crystallization. In general, therefore, these compounds do not serve well as photographic dye stabilizers for excellent effects.

SUMMARY OF THE INVENTION

It is therefore an object of the present invention to provide a silver halide color photographic material which enables the inhibition of deterioration of photographic image quality, particularly the quality of cyan images with time.

It is another object of the present invention to provide a color photographic light-sensitive material which provides a stabilized cyan image by incorporating in a photographic layer a stabilizer having a sufficient effect of inhibiting deterioration or discoloration of cyan images without causing fog, or deterioration of color hue, or reducing the density of formed dyes.

It is a further object of the present invention to provide a silver halide color photographic material which causes no decrease in dye-forming rate and maximum color density when developed with a color developing solution, particularly with a color developing solution free of benzyl alcohol, and causes little or no color density drop when processed with a bleaching solution having a weak oxidizing power (e.g., containing sodium salt of EDTA iron (III) or ammonium salt of EDTA (III)) or a fatigued bleach solution.

These and other objects of the present invention will become more apparent from the following detailed description and examples.

As a result of extensive studies of the stability of cyan images, the present inventors found that certain kinds of hindered phenols and hindered amines are effective for the improvement of the stability of magenta and yellow images. The inventors described this in Japanese Patent Application (OPI) No. 222852/85, U.S. Pat. No. 4,622,287, and EP 161,557A2. Surprisingly, it has now been found that the stability of cyan image is highly improved when used in combination with at least one nitrogen-containing heterocyclic condensed cyan coupler represented by formula (C-I) of the present invention and at least one compound formula (A-I) or (A-II).

Formula (C-I) is represented by

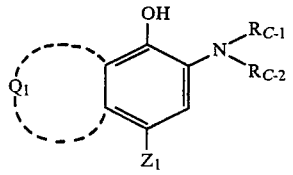

(C-I)

wherein $Q_1$ represents an atomic group containing at least one nitrogen atom required to form a 5- or more membered nitrogen-containing heterocycle with the carbon atoms to which it is bonded; $Z_1$ represents a hydrogen atom or a group which can be separated upon coupling reaction with an oxide form of a color developing agent; $R_{C-1}$ represents an acyl group or a sulfonyl group; and $R_{C-2}$ represents a hydrogen atom or a $C_{1-8}$ ($C_{1-8}$ refers to a group containing from 1 to 8 carbon atoms) aliphatic group, or the substituents for $R_{C-1}$, $R_{C-2}$, $Z_1$ or $Q_1$ form a dimeric or polymeric coupler.

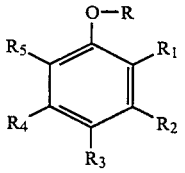

(A-I)

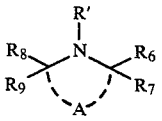

(A-II)

wherein R represents a hydrogen atom, an aliphatic group, an aromatic group, a heterocyclic group, or a hydrolyzable protective group; $R_1$, $R_2$, $R_3$, $R_4$ and $R_5$ (which may be the same or different) each represents a hydrogen atom or a substituent; R' represents a hydrogen atom, an aliphatic group, an acyl group, a sulfonyl group, a sulfinyl group, an oxyradical group, or a hydroxyl group; A represents a non-metallic atomic group required to form a 5-, 6- or 7-membered ring; and $R_6$, $R_7$, $R_8$ and $R_9$ (which may be the same or different) each represents a hydrogen atom or an alkyl group, or the substituents represented by R and $R_1$ or two of $R_1$, $R_2$, $R_3$, $R_4$ and $R_5$ in formula (A-I) which are in an ortho-position relation are bonded to each other to form a 5-, 6- or 7-membered ring, or the substituents represented by $R_6$ and $R_7$, $R_8$ and $R_9$, or R' and $R_6$ in formula (A-II) are bonded to each other to form a 5-, 6- or 7-membered ring.

DETAILED DESCRIPTION OF THE INVENTION

The coupler represented by formula (C-I) is further described below.

In formula (C-I), $Q_1$ represents an atomic group containing at least one nitrogen atom required to form a 5- or more membered nitrogen-containing heterocycle with the carbon atoms to which it is bonded. Examples of the divalent group for the formation of the ring containing no nitrogen atoms include a divalent amino group, an ether bond, a thioether bond, an alkylene group, a vinylene bond, an imino bond, a sulfonyl bond, a carbonyl group, an arylene group, and a divalent heterocyclic group. These groups and bonds may be used singly or in combination. These groups and bonds may further contain substituents. Specific examples of such an arylene group include a group represented by the formula

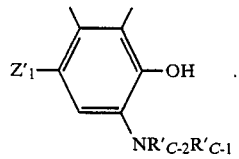

If this arylene group is used, the coupler is a dimeric coupler. $Z'_1$, $R'_{C-1}$ and $R'_{C-2}$ have the same meaning as $Z_1$, $R_{C-1}$ and $R_{C-2}$ defined hereinafter, with the proviso that $Z_1$ and $Z'_1$, $R_{C-1}$ and $R'_{C-1}$, and $R_{C-2}$ and $R'_{C-2}$ may be the same or different.

$Q_1$ is preferably represented by the formula —$NR_{C-3}$-CO—$Q'_1$—. Examples of $Q'_1$ include a divalent amino group, an ether bond, a thioether bond, an alkylene group, a vinylene bond, an imino bond, a sulfonyl group, a carbonyl group, an arylene group, a divalent heterocyclic group, and combinations thereof. These groups and bonds may further contain substituents.

The most preferred cyan couplers according to the present invention are represented by formula (C-1a) or (C-1b):

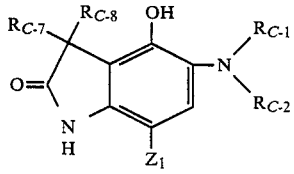

(C-1a)

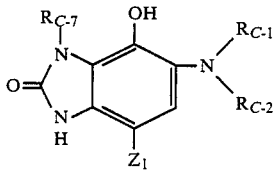

(C-1b)

wherein $R_{C-7}$ and $R_{C-8}$ each represents an aliphatic group or forms a ring when combined with each other; $R_{C-1}$, $R_{C-2}$ and Z each has the same meaning as defined in formula (C-1).

Preferred $R_{C-7}$ and $R_{C-8}$ each represents an alkyl group having from 1 to 16 carbon atoms which may be straight or branched chain; $R_{C-1}$ and $R_{C-2}$ preferably form a cyclic group, which is preferably 5- or 6-membered ring.

The cyclic group or $R_{C-1}$ and $R_{C-2}$ may be a homo (carbon) or hetero cyclic group, and preferably a saturated carbon cyclic group. As an aliphatic group of $R_{C-1}$ and $R_{C-2}$ an alkyl group having from 1 to 9 carbon atoms, such as methyl, ethyl, butyl, heptyl and nonyl group, is preferred, which may be straight or branched chain.

$Z_1$ represents a hydrogen atom or a coupling-off group (i.e., a group which separates (is cleaved) upon occurrence of a coupling reaction with an oxidized form of a color developing agent). Examples of such a coupling-off group include a halogen atom such as a fluorine atom, a chlorine atom, and a bromine atom, an alkoxy group such as an ethoxy group, a dodecyloxy group, a methoxyethylcarbamoylmethoxy group, a carboxypropyloxy group, and a methylsulfonylethoxy group, an aryloxy group such as a 4-chlorophenoxy group, a 4-methoxyphenoxy group, and a 4-carboxyphenoxy group, an acyloxy group such as an acetoxy group, a tetradecanoyloxy group, and a benzoyloxy group, a sulfonyloxy group such as a methanesulfonyloxy group, and a toluenesulfonyloxy group, an amido group such as a dichloroacetylamino group, a heptafluorobutyrylamino group, a methanesulfonylamino group, and a toluenesulfonylamino group, an alkoxycarbonyloxy group such as an ethoxycarbonyloxy group, a benzyloxycarbonyloxy group, an aryloxycarbonyloxy group, an aliphatic or aromatic thio group such as an ethylthio group, a phenylthio group, and a tetrazolylthio group, an imido group such as succinimido group, a hydantoinyl group, and an aromatic azo group such as a phenylazo group. These coupling-off groups may contain a photographically useful group.

In formula (C-I), $R_{C-1}$ represents an acyl group or a sulfonyl group which can be represented by the formulae —CO—$X_1$—$R_{C-4}$ or —$SO_2$—$X_1$—$R_{C-4}$, respectively, in which $X_1$ represents —O—, —$NR_{C-5}$— or a chemical bond, and $R_{C-4}$ represents a chain or cyclic, preferably a $C_{1-32}$ aliphatic group, such as a methyl group, a butyl group, a tridecyl group and a cyclohexyl group, an aryl group such as a phenyl group, and a naphthyl group, or a heterocyclic group such as a 2-pyridyl group, a 2-imidazolyl group, a 2-furyl group, and a 6-quinolyl group. These groups represented by $R_{C-4}$ may further contain substituents selected from the group consisting of alkyl groups, aryl groups, heterocyclic groups, alkoxy groups such as a methoxy group and a 2-methoxyethoxy group, aryloxy groups such as a 2,4-di-tertamylphenoxy group, a 2-chlorophenoxy group and a 4-cyanophenoxy group, alkenyloxy groups such as a 2-propenyloxy group, acyl groups such as an acetyl group and a benzoyl group, ester groups such as a butoxycarbonyl group, a phenoxycarbonyl group, an acetoxy group, a benzoyloxy group, a butoxysulfonyl group and a toluenesulfonyloxy group, amido groups such as an acetylamino group, an ethylcarbamoyl group, a dimethylcarbamoyl group, a methanesulfonamido group and a butylsulfamoyl group, sulfamido groups such as a dipropylsulfamoylamino group, imido groups such as a succinimido group and a hydantoinyl group, ureido groups such as a phenylureido group and a dimethylureido group, aliphatic or aromatic sulfonyl groups such as a methanesulfonyl group and a phenylsulfonyl group, aliphatic or aromatic thio groups such as an ethylthio group and a phenylthio group, hydroxy groups, cyano groups, carboxy groups, nitro groups, sulfo groups and halogen atoms.

These aliphatic groups may be straight chain, branched or cyclic, and may be saturated or unsaturated.

$R_{C-2}$ and $R_{C-5}$ each represents a hydrogen atom or a $C_{1-8}$ aliphatic group such as a methyl group, an ethyl group, an isopropyl group, a cyclohexyl group, a 2-ethylhexyl group or an allyl group. These groups may further contain substituents as described with reference to $R_{C-4}$.

$R_{C-3}$ represents a hydrogen atom or a group represented by the formula —$X_2$—$R_{C-6}$ which can be bonded to a nitrogen atom in which $X_2$ represents a chemical bond or a divalent linking group such as a divalent amino group, an ether bond, a thioether bond, an alkylene group, an ethylene bond, an imino bond, a sulfonyl group, a sulfoxy group and a carbonyl group. These groups and bonds may be used in combination. These groups and bonds may further contain substituents. In the above formula, $R_{C-6}$ has the same meaning as $R_{C-4}$.

$Z_1$ preferably represents a hydrogen atom, a halogen atom, an aryloxy group, or an alkoxy group, and particularly preferably a chlorine atom.

Preferred examples of rings formed by $Q_1$ are 5- to 8-membered rings, and particularly preferably are 5- to 7-membered rings.

In formula (C-I), $R_{C-3}$ preferably is a hydrogen atom, or an alkyl group, particularly preferably a hydrogen atom.

In formula (C-I), $R_{C-1}$ preferably is a group represented by the formula —CO—$X_1$—$R_{C-4}$, and particularly preferably is —CO—$R_{C-4}$ (i.e., wherein $X_1$ is simply a chemical bond).

In formula (C-I), $R_{C-2}$ preferably is a hydrogen atom. If the coupler of formula (C-I) constitutes a dimeric coupler, it is preferably formed via $Q_1$ or $R_{C-1}$.

If the coupler of formula (C-I) constitutes a polymeric coupler, it is preferably formed via $Z_1$ or $R_{C-1}$, particularly preferably $R_{C-1}$.

Specific examples of cyano couplers in accordance with the present invention of formula (C-I) are described in detail below, but the present invention is not to be construed as being limited thereto.

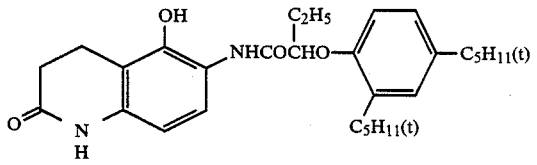

(C-1)

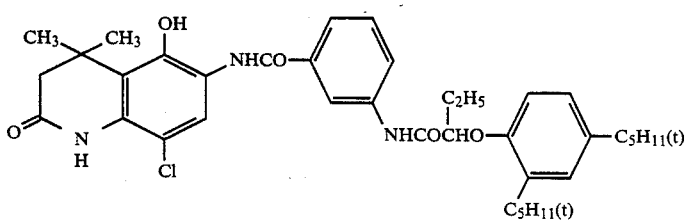

(C-2)

-continued
(C-3)
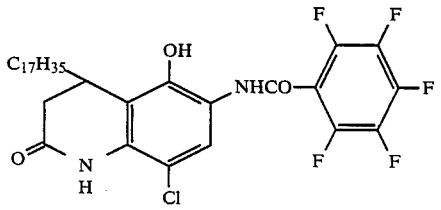
(C-4)
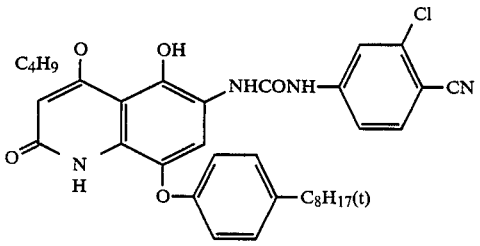
(C-5)
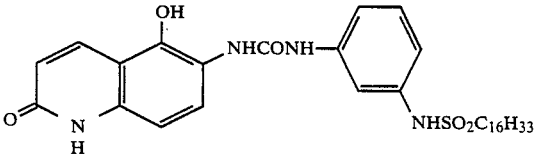
(C-6)
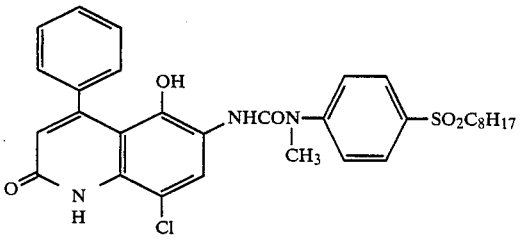
(C-7)
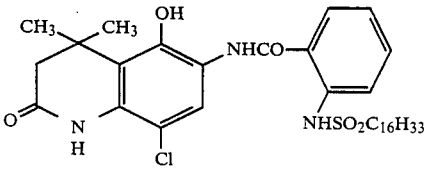
(C-8)
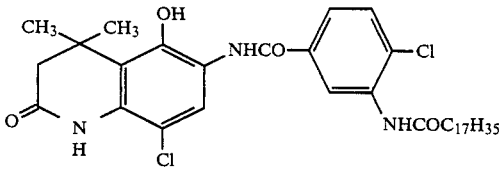
(C-9)
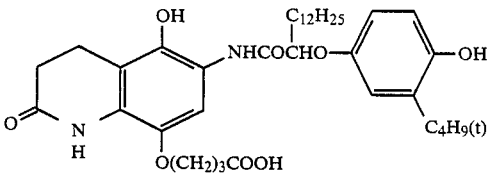
(C-10)
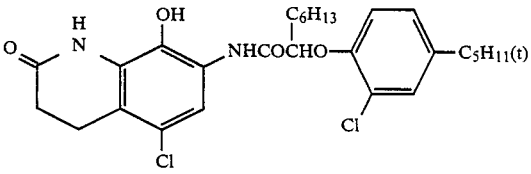

-continued
(C-11)
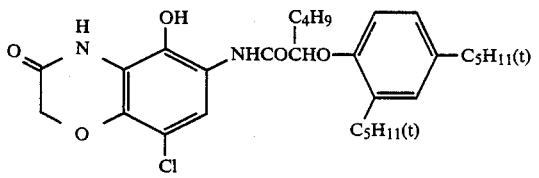
(C-12)
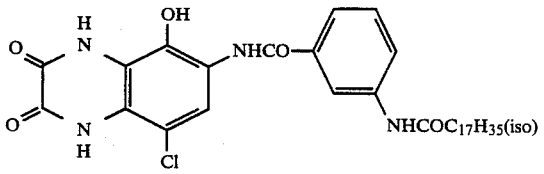
(C-13)
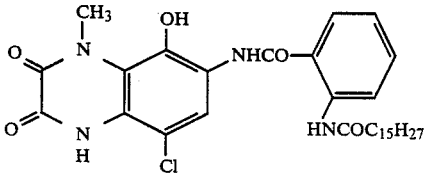
(C-14)
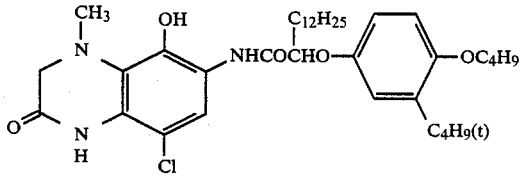
(C-15)
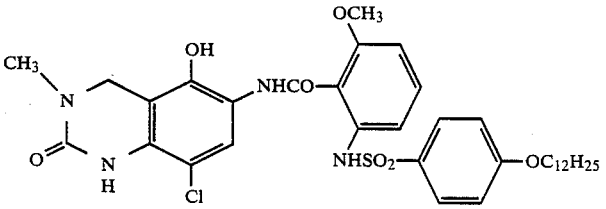
(C-16)
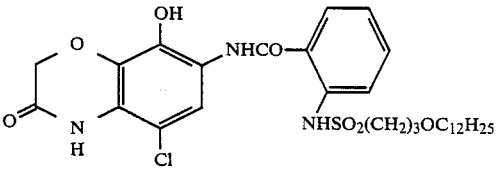
(C-17)
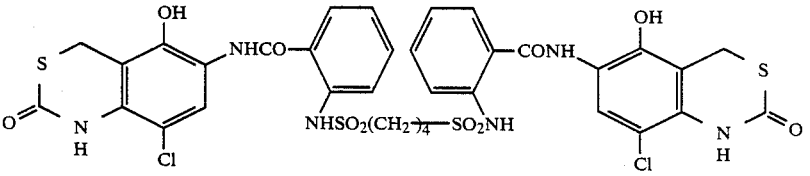
(C-18)
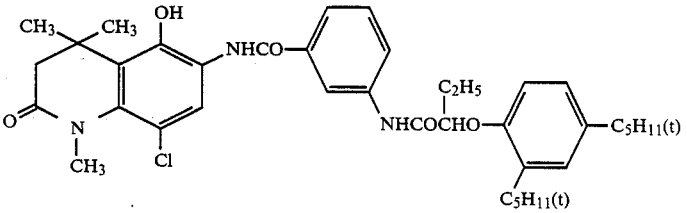

-continued
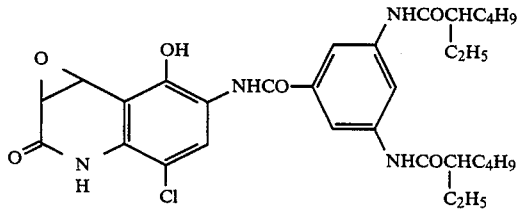
(C-19)
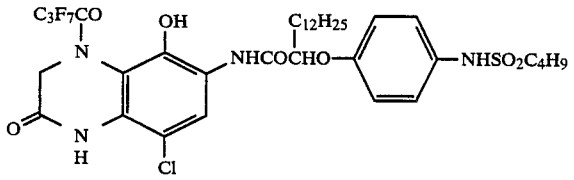
(C-20)
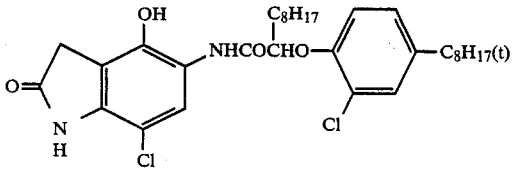
(C-21)
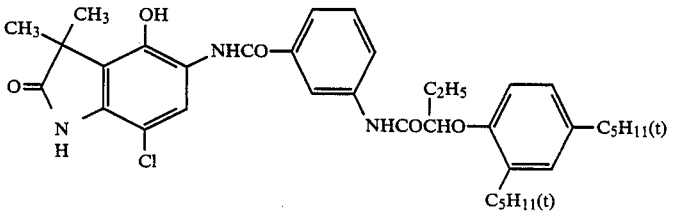
(C-22)
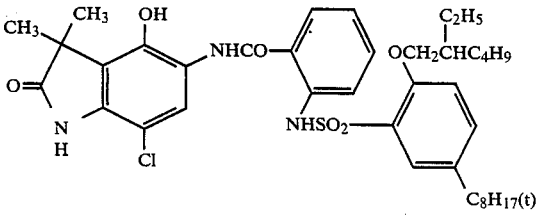
(C-23)
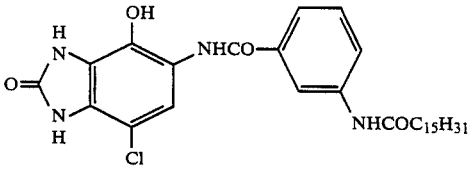
(C-24)
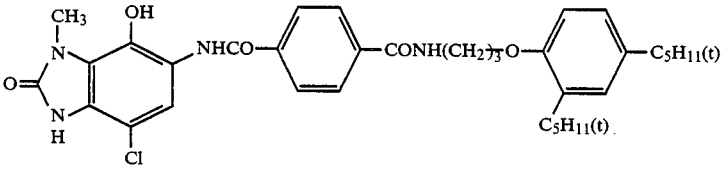
(C-25)
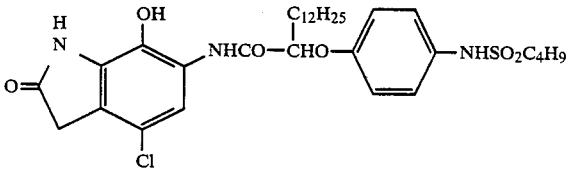
(C-26)

-continued
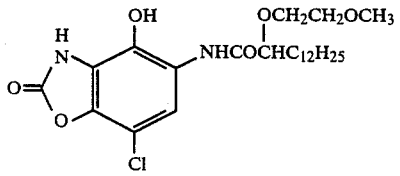
(C-27)
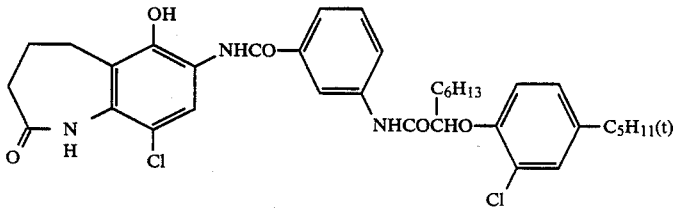
(C-28)
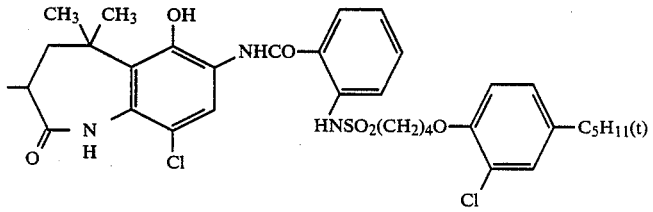
(C-29)
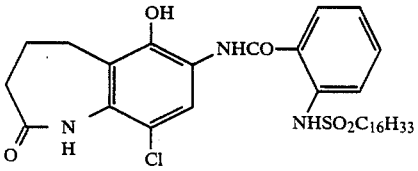
(C-30)
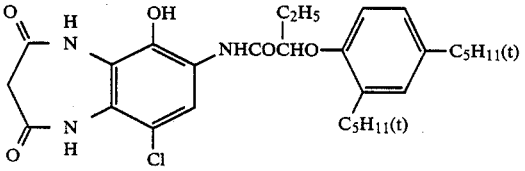
(C-31)
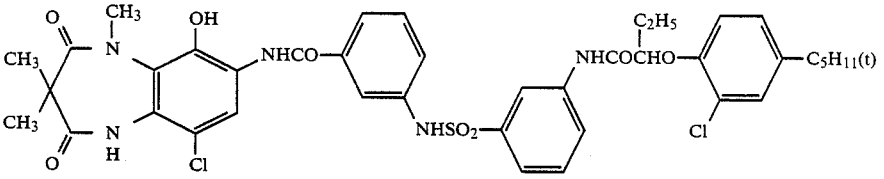
(C-32)
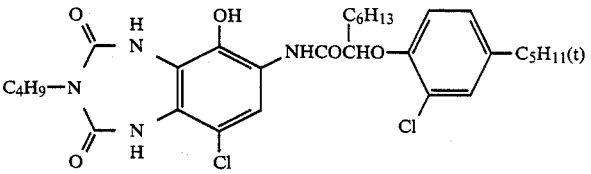
(C-33)
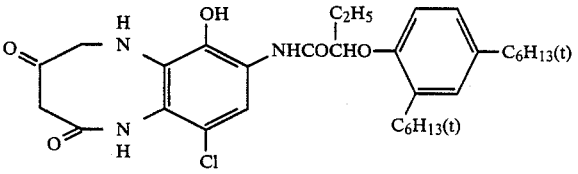
(C-34)

-continued
(C-35)
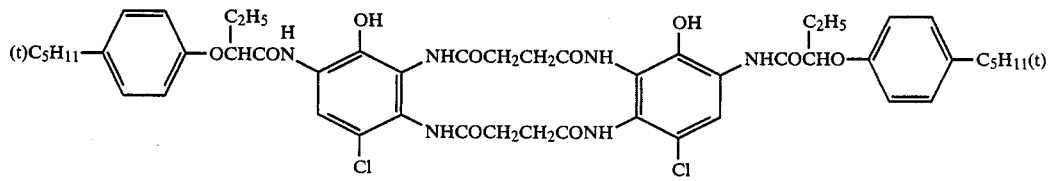
(C-36)
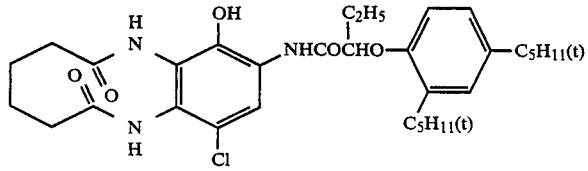
(C-37)
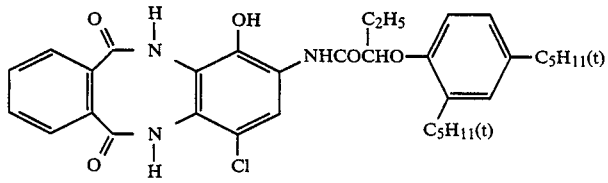
(C-38)
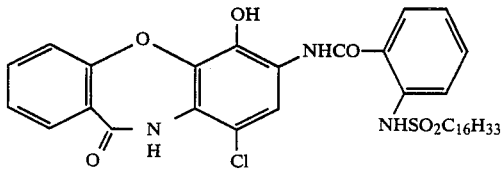
(C-39)
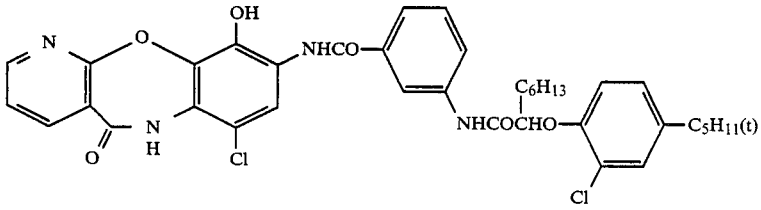
(C-40)
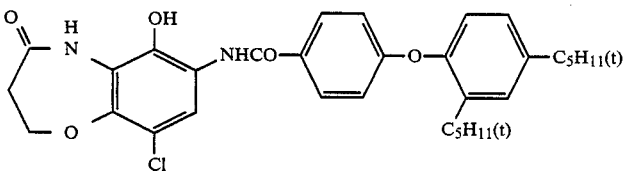
(C-41)
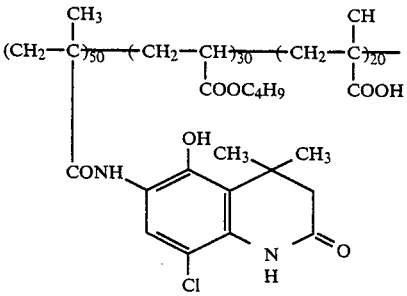

-continued
(C-42)
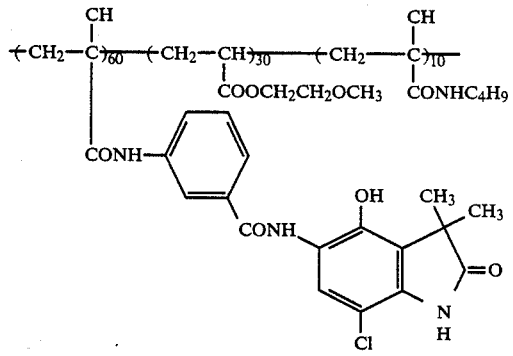
(C-43)
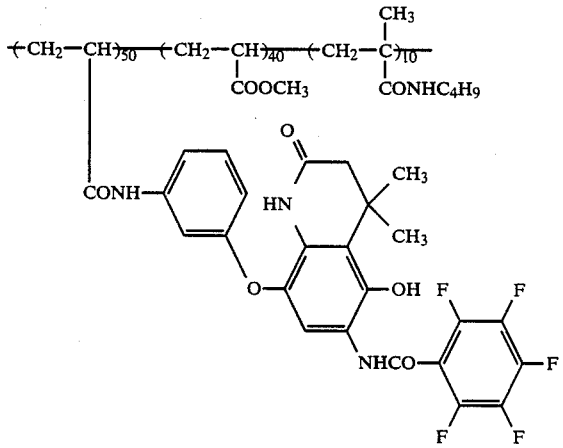
(C-44)
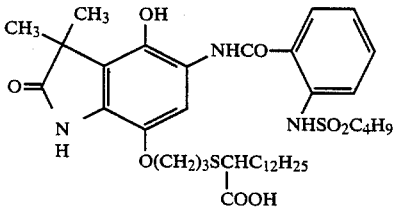
(C-45)
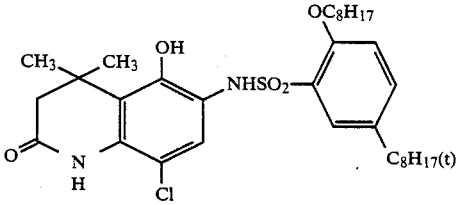
(C-46)
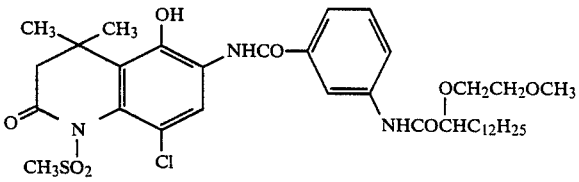
(C-47)
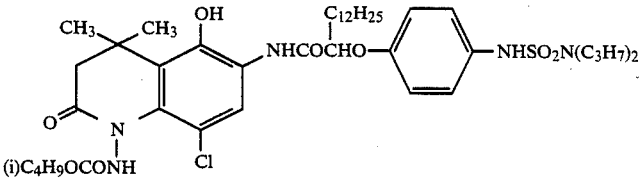

-continued
(C-48)
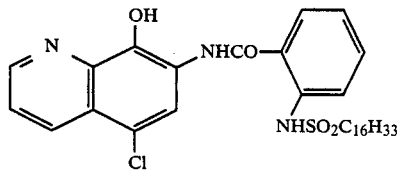
(C-49)
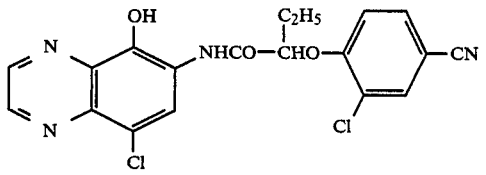
(C-50)
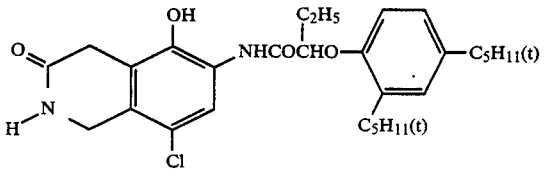
(C-51)
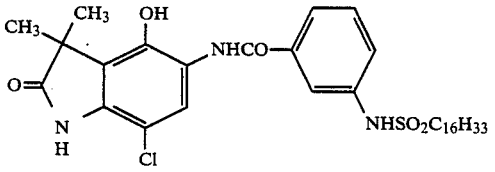
(C-52)
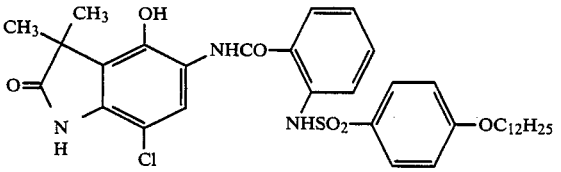
(C-53)
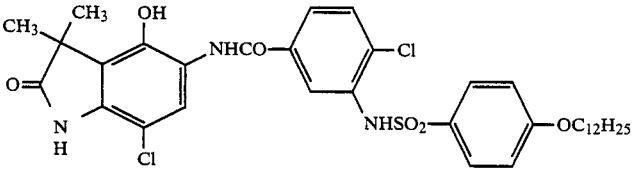
(C-54)
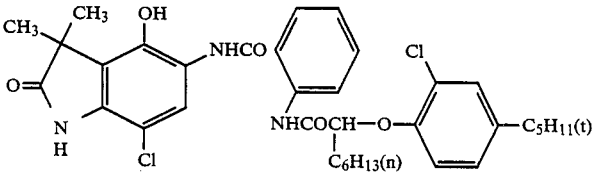
(C-55)
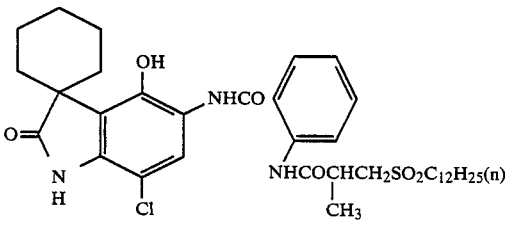

-continued (C-56)

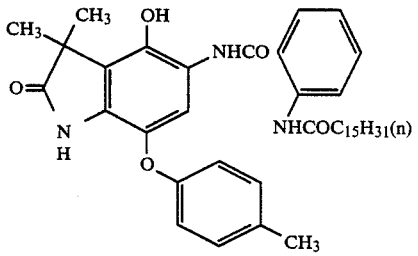

(C-57)

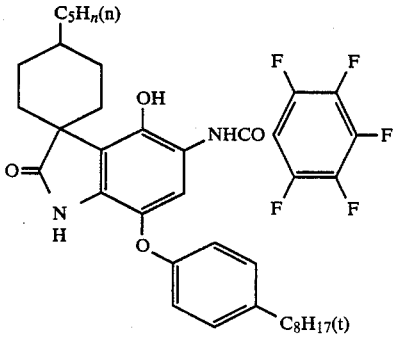

Synthesis of the cyan coupler of formula (C-I) of the present invention can be accomplished by known methods as described, e.g., in U.S. Pat. Nos. 4,327,173, 4,430,423 and 4,564,586.

SYNTHESIS EXAMPLES

Synthesis of 6-[2-(2,4-Di-tert-amylphenoxy)butanamido]-5-hydroxy-3,4-dihydrocarbostyryl (Exemplary Coupler (C-1))

(i) Synthesis of 5-Hydroxy-6-nitro-3,4-dihydrocarbostyryl 25 g of 5-hydroxy-3,4-dihydrocarbostyryl was dissolved in 110 ml of anhydrous acetic acid. A mixture of 12 g of fuming nitric acid and 75 ml of acetic acid was added dropwise to the solution. The admixture was stirred at a temperature of 5° C. for 2 hours. 20 g of ice was then added to the solution. The resulting crystal was filtered off. The crystal was then suspended in 3N sodium hydroxide solution. The suspesnion was filtered. The filtrate was neutralized with hydrochloric acid. The resulting crystal was filtered off, washed with water, and then dried to obtain 22 g of the desired object.

(ii) Synthesis of 6-[2-(2,4-Di-tert-amylphenoxy)-butanamido]-5-hydroxy-3,4-dihydrocarbostyryl 100 ml of acetone and 16.3 ml of triethylamine were added to 22 g of 5-hydroxy-6-nitro-3,4-dihydrocarbostyryl thus obtained. 37.7 g of 2-(2,4-di-tert-amylphenoxy)butanoylchloride was added dropwise to the admixture at room temperature (about 20° C.). The admixture was then stirred at room temperature for 1 hour. 100 ml of ethyl acetate was added to the solution. The resulting crystal of triethylamine hydrochloride was filtered off. The filtrate was concentrated under reduced pressure and crystallized from hexane to obtain 34 g of a crystal (m.p. 101°-105° C.). 150 ml of acetic acid, 70 l of ethanol, and 30 ml of water were added to the crystal. 32 g of reduced iron was gradually added to the admixture under reflux. The reflux then continued for 1 hour. The solution was poured into water. The solution was extracted with ethyl acetate. The solution was then washed with water. The solvent was removed under reduced pressure. The solution was crystallized from acetonitrile to obtain 26 g of the desired coupler having an m.p. of 203° to 205° C.

| | Elementary Analysis: | | |
|---|---|---|---|
| | C | H | N |
| Found (%): | 72.45 | 8.45 | 5.65 |
| Calcd. (%): | 72.47 | 8.39 | 5.83 |

The substituents represented by formulae (A-I) and (A-II) will be further illustrated hereinafter.

Examples of the present aliphatic group include a straight chain, branched, and cyclic alkyl group, alkenyl group and alkynyl group. These groups may be further substituted by substituents. The present aromatic group may be a carbon-cyclic group, a heterocyclic group, or a condensed ring group. These groups may be further substituted by substituents.

R represents a hydrogen atom, an aliphatic group, an aromatic group, a heterocyclic group such as a triazole group, a pyrazole group, a pyranyl group, and a furanyl group, or a hydrolyzable protective group. The term "a hydrolyzable protective group" as used herein means a silyl group, a phosphoric ester group, or a group represented by formula (A-III)

$$R''—X—Y \qquad \text{(A-III)}$$

wherein R'' represents an aliphatic group, an aromatic group, or a heterocyclic group; X represents a single bond, $$-O-,\ -S-,\ -\overset{\overset{R'''}{|}}{N}-,\ -\underset{\underset{O}{\|}}{C}-$$

or a combination thereof in which R''' represents a hydrogen atom, an aliphatic group, an aromatic group, a heterocyclic group, an acyl group, or a sulfonyl group; and Y represents $-\underset{\underset{O}{\|}}{C}-$ or $-SO_2-$.

In formula (A-I), $R_1$, $R_2$, $R_3$, $R_4$ and $R_5$ each represents a hydrogen atom or a substituent such as an alkyl group, an alkenyl group, an aryl group, an amino group, an alkylamino group, an acylamino group, a sulfonamido group, an acyl group, an alkyloxycarbonyl group, an aryloxycarbonyl group, an alkylthio group, an arylthio group, a halogen atom, a cyano group, a nitro group, a sulfo group, a carboxyl group, a carbamoyl group, a sulfamoyl group, a sulfonyl group, and —O—R. These groups may be further substituted.

In formula (A-II), R′ represents a hydrogen atom, an aliphatic group, an acyl group such as an acetyl group, an acryloyl group, a pivaloyl group, a myristoyl group, a benzoyl group, and a nphthoyl group, a sulfonyl group such as a methanesulfonyl group, an ethanesulfonyl group, a dodecanesulfonyl group, a pentadecanesulfonyl group, and a benzenesulfonyl group, a sulfinyl group such as a methanesulfinyl group, a betanesulfinyl group, a cyclohexanesulfinyl group, a dodecanesulfinyl group, and a benzenesulfinyl group, an oxyradical group, or a hydroxyl group.

"A" represents a non-metallic atomic group forming a 5-, 6-, or 7-membered ring (atomic group selected from the group consisting of carbon atoms, hydrogen atoms, nitrogen atoms, oxygen atoms, and sulfur atoms singly or in combination). These rings may further contain substituents.

$R_6$, $R_7$, $R_8$ and $R_9$ may be the same or different and each represents a hydrogen atom, or a substituted or unsubstituted alkyl group such as a methyl group, an ethyl group, a propyl group, a butyl group, a methoxyethyl group, a benzyl group, a sec-butyl group, or a cyclohexyl group.

In the substituents represented by formula (A-I), R and $R_1$ or two of $R_1$, $R_2$, $R_3$, $R_4$ and $R_5$ which are in an ortho-position relation may be bonded to each other to form a 5-, 6- or 7-membered ring. This ring may be monocyclic, polycyclic, alicyclic, heterocyclic, aromatic, or spirocyclic, and may be further substituted.

In the substituents represented by formula (A-II), $R_6$ and $R_7$, $R_8$ and $R_9$, or R′ and $R_6$ may be bonded to each other to form a 5-, 6- or 7-membered ring. This ring may be monocyclic, polycyclic, alicyclic, heterocyclic, aromatic, or spirocyclic, and may be further substituted.

In formula (A-I), at least one of $R_1$ and $R_3$ is preferably an alkyl group, an amino group, an alkylamino group, an acylamino group, a sulfonamido group, an alkyloxycarbonyl group, an aryloxycarbonyl group, or —O—R in the light of the effects of the present invention.

In formula (A-II), A is preferably an atomic group forming a 6-membered ring, particularly an atomic group required to form a piperidine ring.

Typical examples of compounds according to formulae (A-I) and (A-II) are illustrated, but the present invention is not to be construed as being limited thereto.

A-1

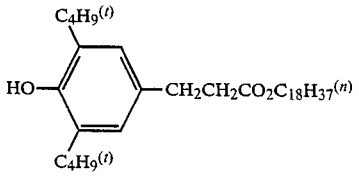

A-2

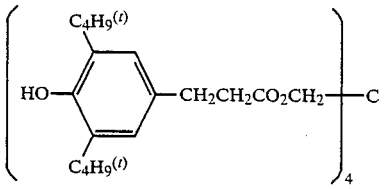

A-3

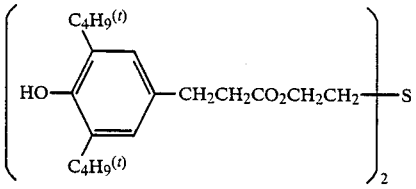

A-4

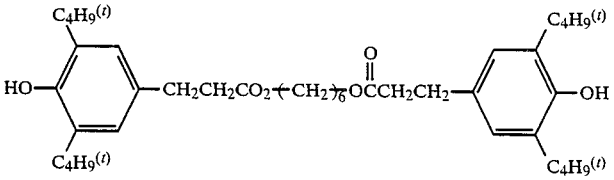

-continued
A-5
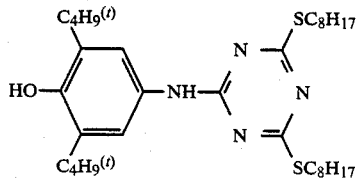
A-6
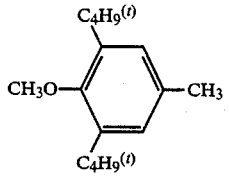
A-7
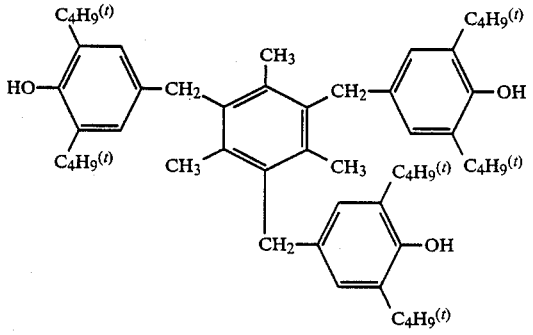
A-8
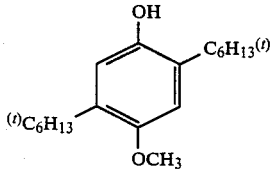
A-9
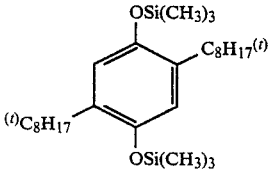
A-10
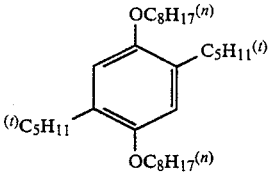
A-11
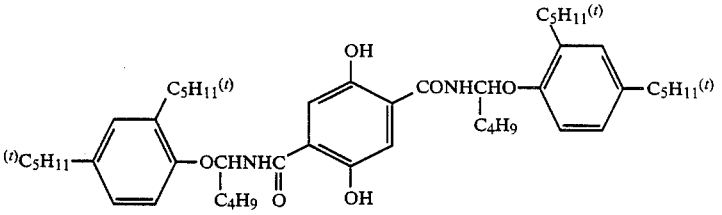
A-12
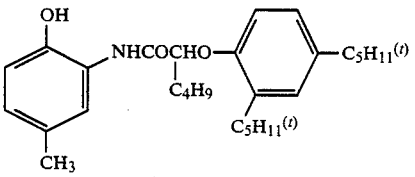

-continued
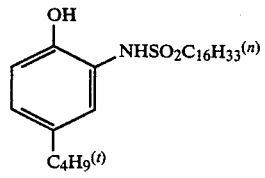
A-13
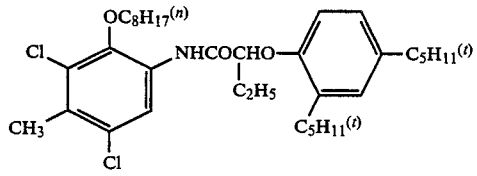
A-14
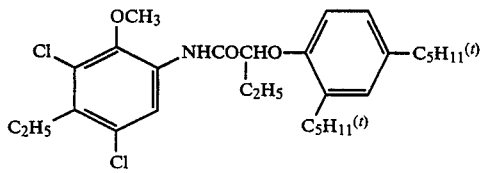
A-15
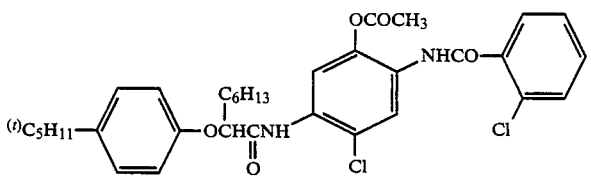
A-16
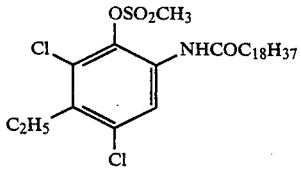
A-17
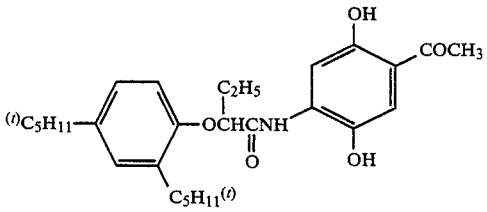
A-18
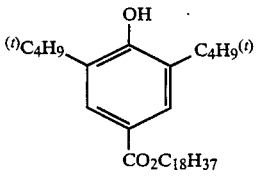
A-19
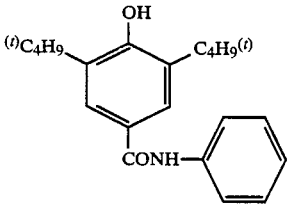
A-20

Synthesis of compounds represented by formula (A-I) and (A-II) can be accomplished by known methods as described, e.g., in British Patents 1,326,889, 1,354,313, and 1,410,846, U.S. Pat. Nos. 3,336,135, 4,268,593, 4,558,131, and 4,584,265, Japanese Patent Publication Nos. 1420/76, and 6623/77, and Japanese Patent Application (OPI) Nos. 114036/83 (U.S. Pat. No. 4,452,884), 5246/84, 73152/86, 86750/86 (U.S. Pat. No. 4,656,125), 90155/86, 90156/86 (U.S. Pat. No. 4,623,617) and 172246/86.

The layer in the same layer as or different layer from the present cyan coupler which is sensitive to substantially the same light as the present cyan coupler can comprise other known cyan couplers. A particularly preferred example of such a cyan coupler is represented by formula (C-II)

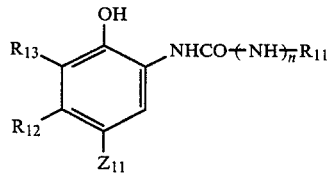

(C-II)

wherein $R_{11}$ represents a substituted or unsubstituted aliphatic, aryl, or heterocyclic group; $R_{12}$ represents a substituted or unsubstituted aliphatic, aryl, or acylamino group; $R_{13}$ represents a hydrogen atom, a halogen atom, or a substituted or unsubstituted aliphatic, aryl, alkoxy, aryloxy or acylamino group; $Z_{11}$ represents a hydrogen atom, or a coupling-off group; and n represents an integer of 0 or 1.

Typical examples of the cyan coupler represented by formula (C-II) are illustrated below.

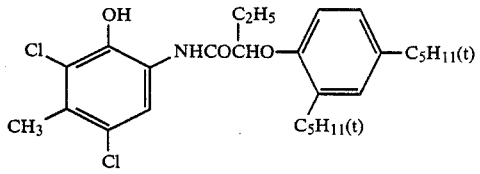

(II-1)

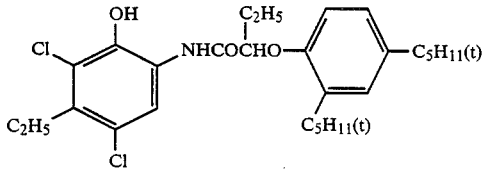

(II-2)

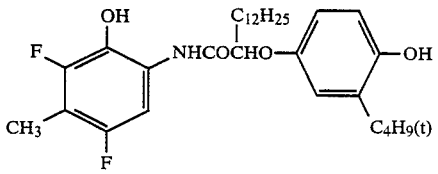

(II-3)

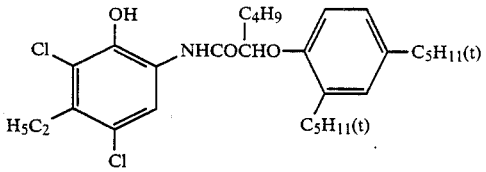

(II-4)

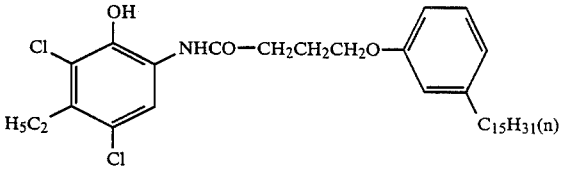

(II-5)

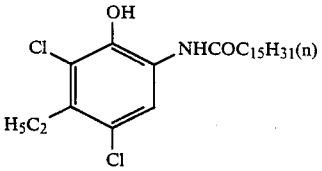

(II-6)

-continued
(II-7)
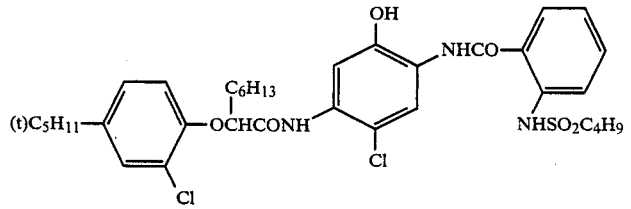
(II-8)
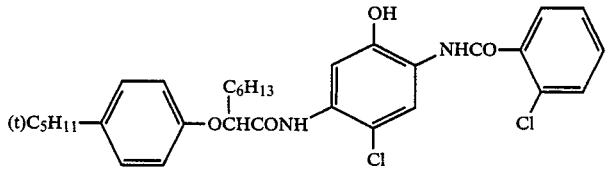
(II-9)
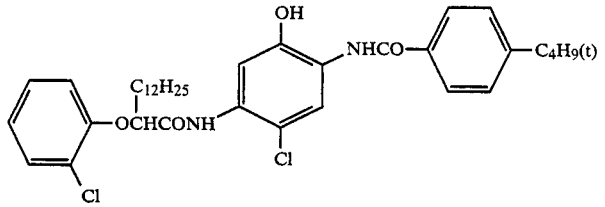
(II-10)
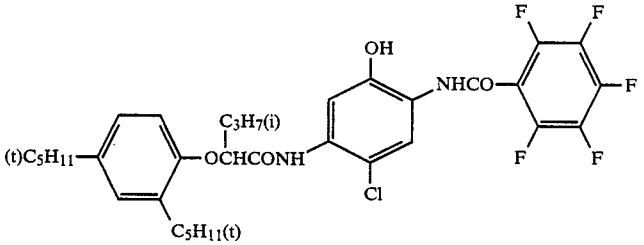
(II-11)
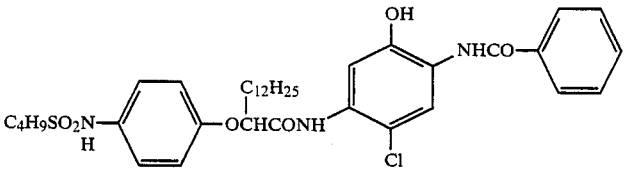
(II-12)
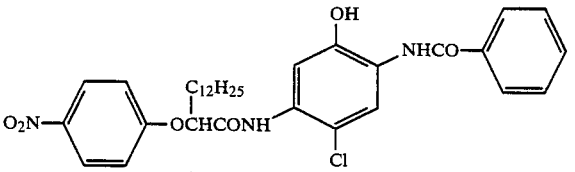
(II-13)
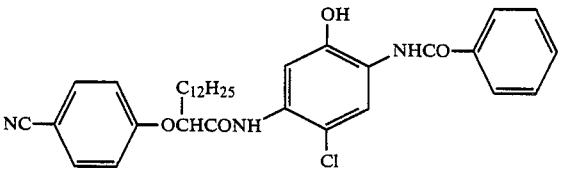

-continued (II-14)

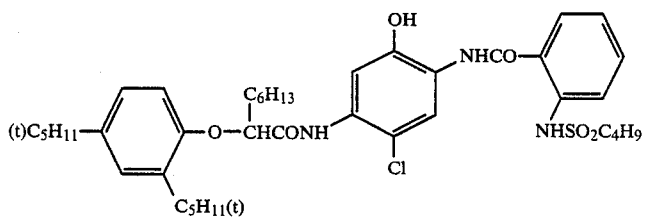

(II-15)

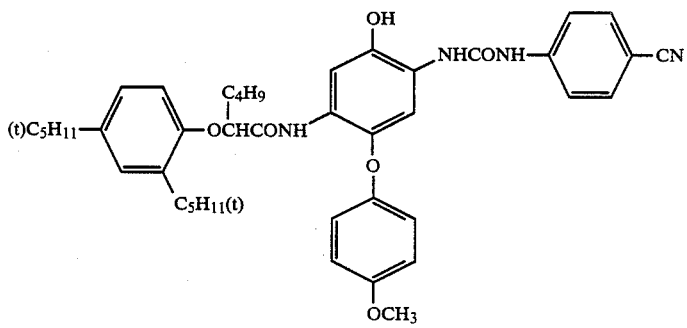

(II-16)

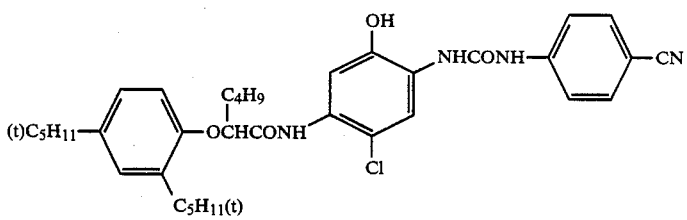

The incorporation of the present cyan coupler and the compounds of formulae (A-I) and (A-II) in the silver halide emulsion layer can be accomplished by known methods. Examples of coupler solvents, ultraviolet absorbers, protective colloids, binders, fog inhibitors, color stain inhibitors, discoloration inhibitors or dye stabilizer, sensitizing dyes, dyes, and bleaching agents which can be incorporated with the present cyan coupler and the process for the preparation of silver halide photographic material (process for the preparation of photographic emulsion, process for incorporation of coupler or the like, process for the construction of support, constituent layers of various light-sensitive layers, etc.) and photographic process which can be used in such a case are described in *Research Disclosure,* RD No. 17643 (December, 1978), Japanese Patent Application (OPI) Nos. 65134/81 and 104333/81.

The amount of cyan coupler of formula (C-I) to be added to the silver halide emulsion layer constituting the light-sensitive layer is generally in the range of from 0.1 to 1.0 mol, and preferably is from 0.1 to 0.5 mol/mol.Ag.

The relative amount of the compound of formula (A-I) or (A-II) to be added to the cyan coupler of (C-I) is generally in the range of from 5 to 200 mol%, and preferably is from 10 to 150 mol%. These compounds are preferably coemulsified with the cyan coupler.

The compounds of formulae (A-I) and (A-II) may be used singly or in combination. In particular, either or both of compounds of formulae (A-I) and (A-II) may be used in combination. Furthermore, these compounds may be used in combination with the previously described known discoloration inhibitors or dye stabilizers.

In the present invention, a magenta coupler and a yellow coupler can be incorporated in the color photographic light-sensitive material in combination with at least one cyan coupler represented by formula (C-I).

In order to form a color image, various color couplers can be used. A useful color coupler is a compound which undergoes coupling reaction with an oxide form of an aromatic primary amine color developing agent to produce or release a substantially nondiffusible dye and is substantially nondiffusible itself. Typical examples of such a useful color coupler include naphthol or phenol compounds, pyrazolone or pyrazoloazole, and open chain or heterocyclic ketomethylene compounds. Specific examples of such cyan, magenta and yellow couplers which can be used in the present invention are described in *Research Disclosure,* RD Nos. 17643 (December, 1978) (p. 25, VII-D) and 18717 (November, 1979).

Typical examples of the yellow coupler which can be used in the present invetion include oxygen atom-releasing type and nitrogen atom-releasing type 2-equivalent yellow couplers. Specifically, α-pivaloylacetanilide couplers are excellent in fastness of color forming dye, particularly to light. On the other hand, α-benzoylacetanilide couplers can provide a high color density.

A preferred example of 5-pyrazolone magenta coupler which can be used in the present invention is a 5-pyrazolone coupler which is substituted in the 3-position by an arylamino or acylamino group (particularly, a sulfur atom-releasing tyep 2-equivalent coupler).

A more preferred example of yellow coupler is a pyrazoloazole coupler. Particularly, pyrazolo[5,1-c][1,2,4]triazoles as described in U.S. Pat. No. 3,725,067 are preferably used. In particular, imidazo[1,2-b]pyrazoles as described in U.S. Pat. No. 4,500,630 are preferably used because they have less side absorption of yellow by color forming dye and excellent fastness to light. Furthermore, pyrazolo[1,5-b][1,2,4]triazoles as described in U.S. Pat. No. 4,540,654 are preferably used.
Specific examples of such yellow couplers are illustrated below.
(Y-1)
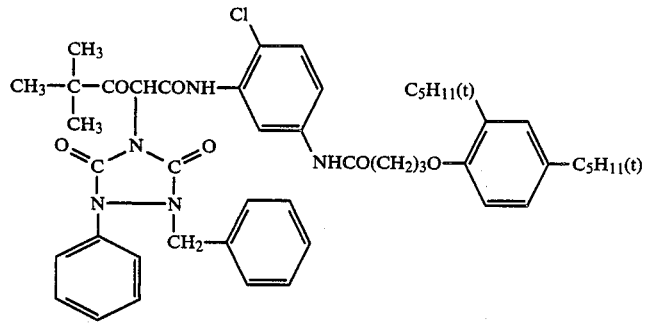
(Y-2)
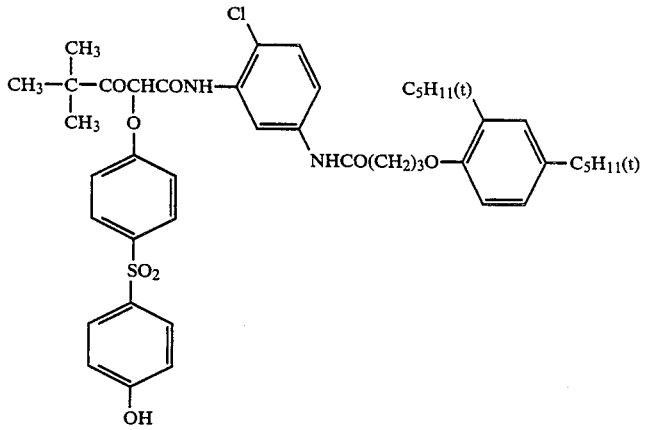
(Y-3)
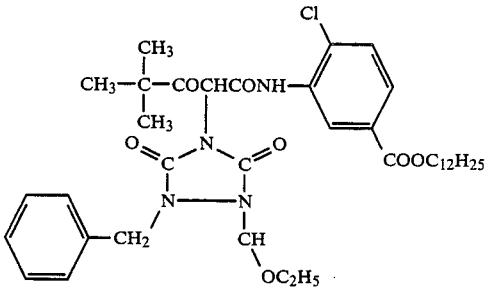
(Y-4)
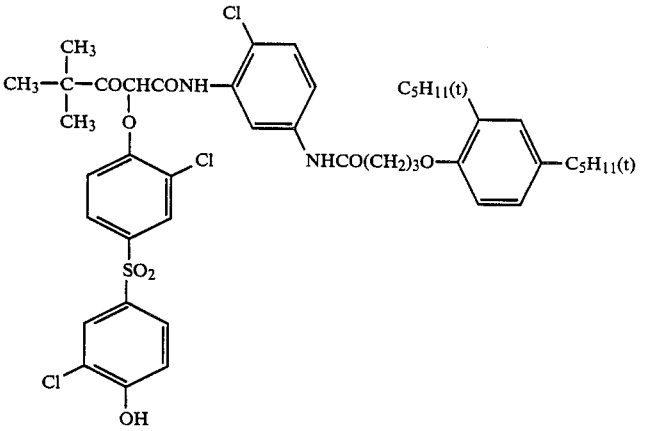

-continued
(Y-5)
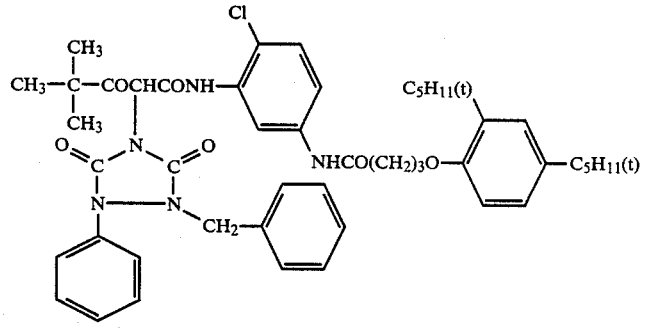
(Y-6)
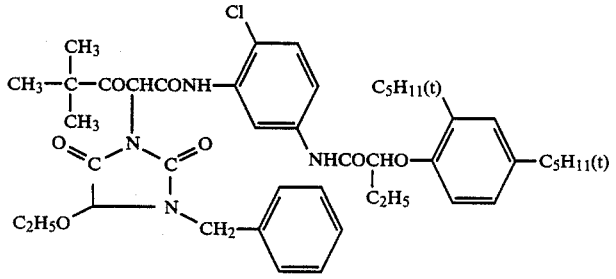
(Y-7)
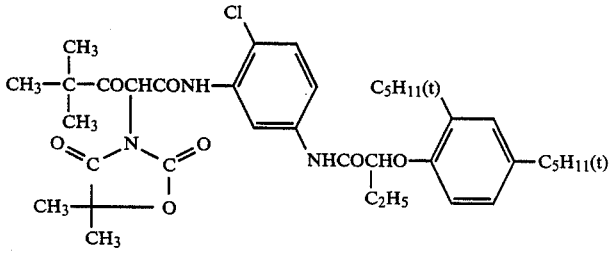
(Y-8)
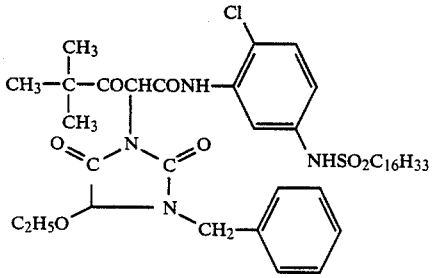
Specific examples of preferred magenta couplers are illustrated below.
(M-1)
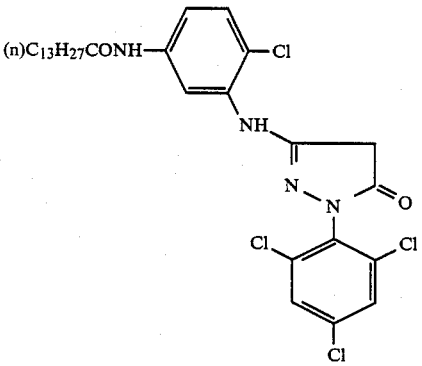

-continued
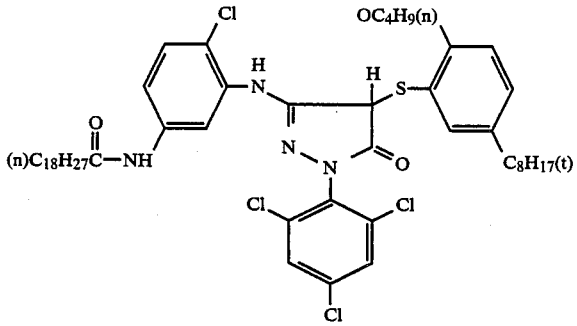
(M-2)
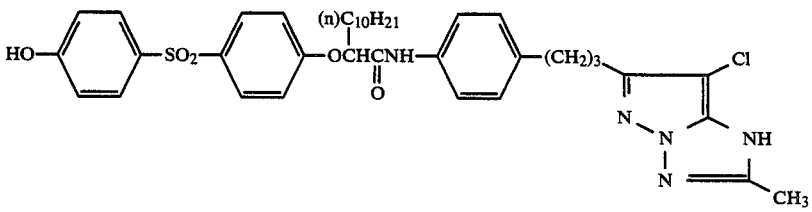
(M-3)
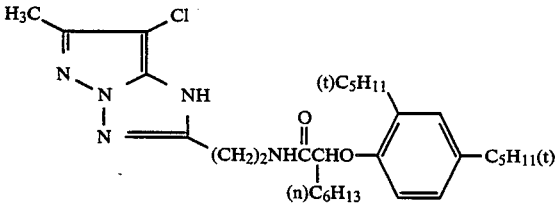
(M-4)
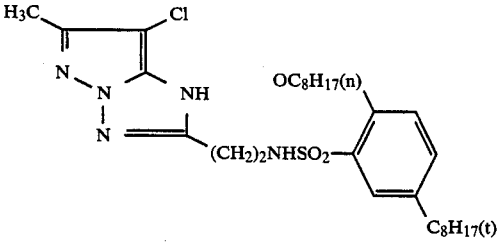
(M-5)
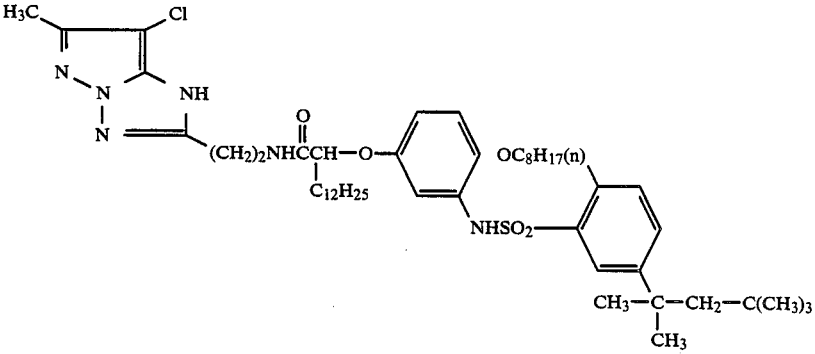
(M-6)

-continued
(M-7)
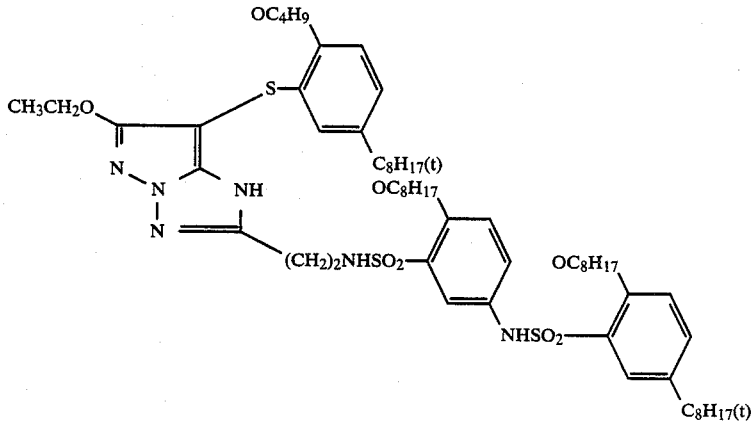
(M-8)
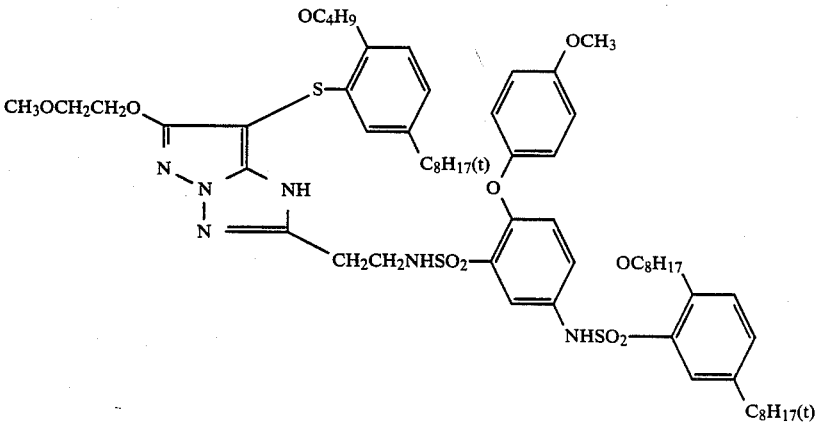
(M-9)
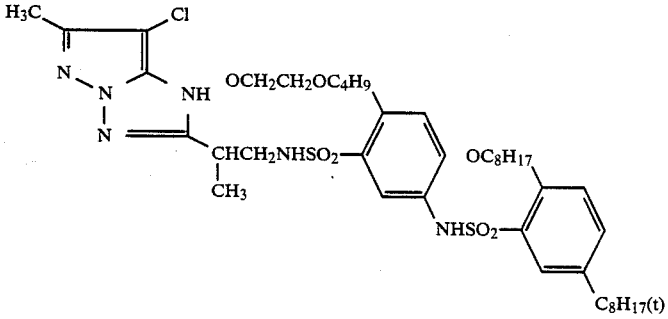
(M-10)
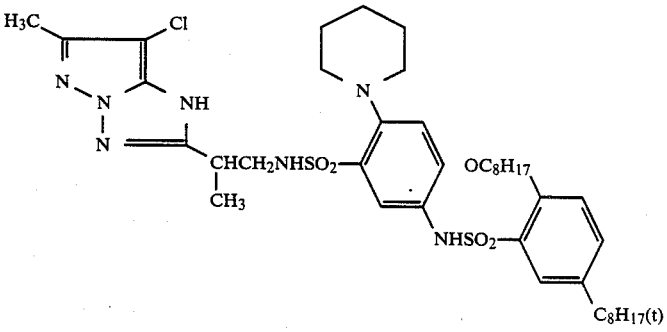

-continued

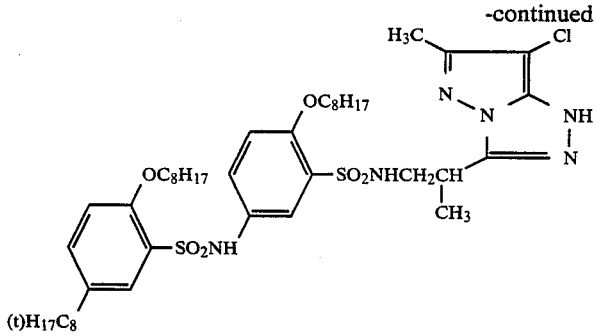

(M-11)

The incorporation of the cyan coupler of formula (C-I), the coupler of formula (A-I) and/or formula (A-II), or the magenta and yellow couplers to be used in combination in the emulsion layer can be accomplished as follows. Particularly, these couplers are dissolved in either or a mixture of a high boiling organic solvent having a boiling point of 160° C. or above such as phthalic alkyl ester (e.g., dibutyl phthalate and dioctyl phthalate), phosphoric ester (e.g., diphenyl phosphate, triphenyl phosphate, tricresyl phosphate, and dioctylbutyl phosphate), citric ester (e.g., acetylcitric tributyl), benzoic ester (e.g., benzoic octyl), alkylamide (e.g., diethyllaurylamide), aliphatic ester (e.g., dibutoxyethyl succinate and dioctyl azelate), and phenols (e.g., 2,4-di-t-amylphenol) and a low boiling organic solvent having a boiling point of 30° to 150° C. such as lower alkyl acetate (e.g., ethyl acetate and butyl acetate), ethyl propionate, secondary butyl alcohol, methyl isobutyl ketone, $\beta$-ethoxyethyl acetate, and methyl cellosolve acetate. The solution is then emulsion-dispersed in a hydrophilic colloidal aqueous solution.

Alternatively, these couplers may be emulsion-dispersed by the following polymer dispersion process.

Examples of such polymer dispersion processes include a process as described in U.S. Pat. No. 3,619,195 which comprises dissolving a coupler and a water-insoluble and organic solvent-soluble polymer (alkyl acrylate series) in an auxiliary solvent, and then dispersing the solution in a hydrophilic colloid, a loadable latex dispersion process as described in U.S. Pat. No. 4,203,716 which comprises dissolving a coupler in a water-miscible organic solvent, mixing the solution with a polymer latex, and then loading (removing the residual solvent for sufficient loading), other dispersion processes using a latex as described in Japanese Patent Publication No. 39853/76, processes using a prepolymer comprising a conjugated diene or vinyl monomer as a high boiling solvent as disclosed in West German Patent Application (OLS) No. 2,830,917, a polymer dispersion process as disclosed in Japanese Patent Application (OPI) No. 25133/76, and a process as disclosed in Japanese Patent Application (OPI) Nos. 107642/85 and 151636/85 which comprises dispersing a product of polymerization of monomers in the presence of a coupler in a hydrophilic binder.

The light-sensitive material comprising the present cyan coupler may comprise special couplers other than the present couplers of the previously described general formulae, incorporated therein as desired. For example, the green-sensitive emulsion layer may contain a colored magenta coupler for a masking effect. Various color-sensitive emulsion layers or their adjacent layers may comprise a development inhibitor-releasing coupler (DIR coupler) or development inhibitor-releasing hydroquinone. A development inhibitor released from these compounds upon development exerts an interlayer interimage effect such as improving image sharpness, image graininess, and monochromatic saturation.

If necessary, the photographic emulsion layer or its adjacent layers in the light-sensitive layer may comprise a coupler which releases a development acceleration or nucleating agent upon development for various effects such as improving photographic sensitivity and color image graininess and providing higher contrast.

The combination of the cyan coupler of formula (C-I) and at least one of the compounds of formulae (A-I) and (A-II) can be used for color negative film, color paper, color positive film, color reversal film for slides, color reversal film for motion pictures, color reversal film for television, and other generally used silver halide color photographic materials.

Furthermore, these couplers can be used in combination with at least one ultraviolet absorber to further improve the effects of the present invention.

Such an ultraviolet absorber may be incorporated in any layer(s). Preferably, such an ultraviolet absorber is incorporated in the layer containing the present cyan coupler or its adjacent layers. Compounds which can be used as such ultraviolet absorbers in the present invention are described in *Research Disclosure,* RD No. 17643 (VIII-C). A preferred example of such ultraviolet absorber is a benzotriazole derivative represented by formula (VIII)

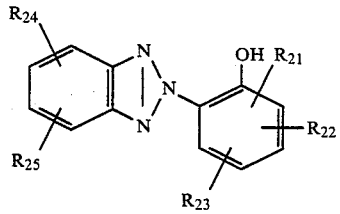

(VIII)

wherein $R_{21}$, $R_{22}$, $R_{23}$, $R_{24}$ and $R_{25}$ (which may be the same or different) each represents a hydrogen atom or a substituent such as those described for aliphatic groups or aryl groups represented by $R_4$ described above with reference to formula (C-I). $R_{24}$ and $R_{25}$ may undergo ring closure to form a 5- or 6-membered aromatic ring containing carbon atoms. These groups and aromatic rings may be further substituted.

The compounds of formula (VIII) can be used singly or in combination. Typical examples of ultraviolet absorbers which can be used in the present invention are illustrated hereinafter. In the following chemical structures, the

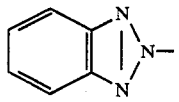
skeleton can be considered as having a resonance structure
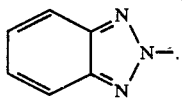
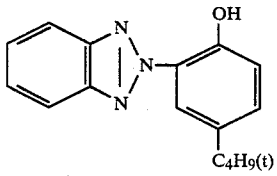
(UV-1)
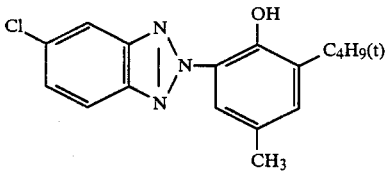
(UV-2)
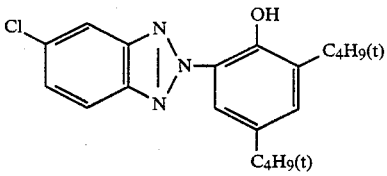
(UV-3)
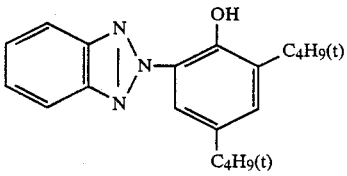
(UV-4)
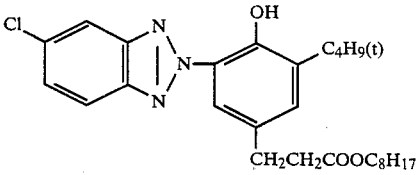
(UV-5)
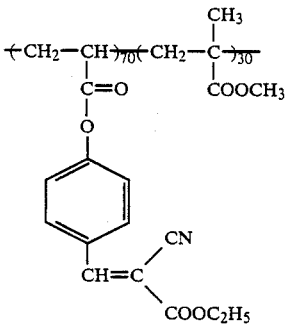
(UV-6)
-continued
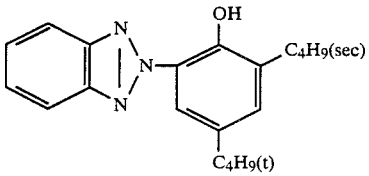
(UV-7)
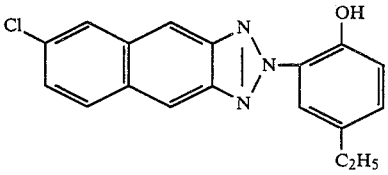
(UV-8)
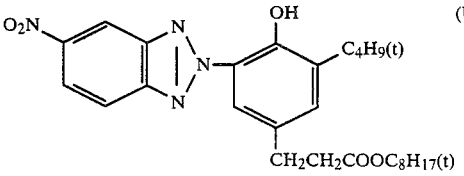
(UV-9)
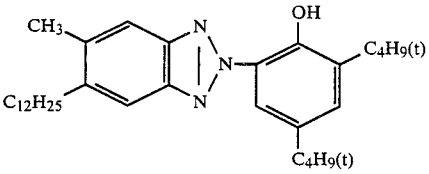
(UV-10)
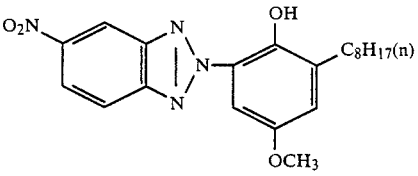
(UV-11)
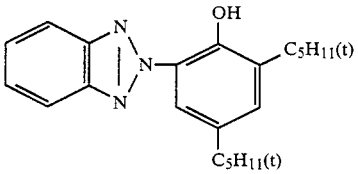
(UV-12)
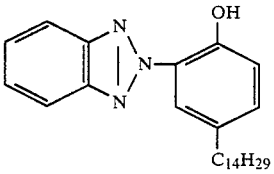
(UV-13)
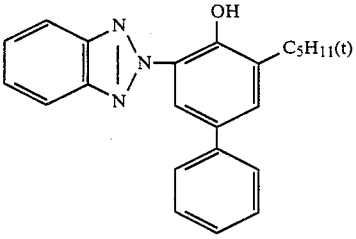
(UV-14)

-continued

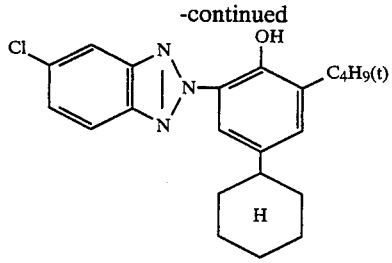

(UV-15)

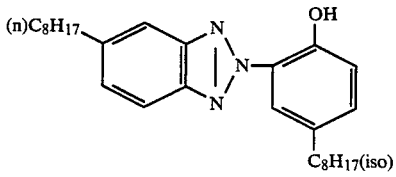

(UV-16)

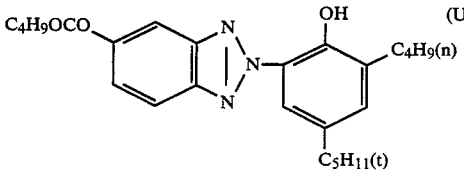

(UV-17)

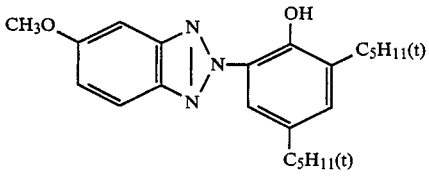

(UV-18)

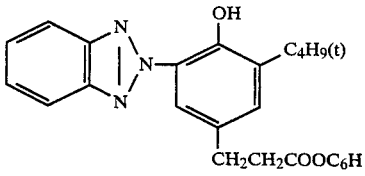

(UV-19)

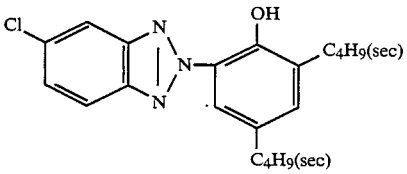

(UV-20)

Examples of synthesis of the compounds of formula (VIII) are described in Japanese Patent Publication No. 29620/69, Japanese Patent Application (OPI) Nos. 151149/75 and 95233/79, U.S. Pat. No. 3,766,205, European Patent No. 0,057,160, and *Research Disclosure,* RD No. 22519 (January 1983). High molecular ultraviolet absorbers as disclosed in Japanese Patent Application (OPI) Nos. 111942/83 (U.S. Pat. No. 4,431,726), and 178351/83 (British Patent No. 218315A and U.S. Pat. No. 4,443,534), U.S. Pat. No. 4,455,368, Japanese Patent Application (OPI) Nos. 19945/84 (U.S. Pat. No. 4,464,463), and 23344/84 (British Patent No. 2127569A and U.S. Pat. No. 4,464,462) can be used. Specific examples of such ultraviolet absorbers include UV-6. A low molecular weight ultraviolet absorber and a high molecular weight ultraviolet absorber can be used in combination.

The above-described ultraviolet absorbers can be emulsion-dispersed in a hydrophilic colloid in the same manner as couplers. The amount of the high boiling organic solvent and the ultraviolet absorber to be used in the present invention is not specifically limited. The amount of the high boiling organic solvent to be used is generally in the range of from 0 to 300% by weight based on the amount of the ultraviolet absorber. Such ultraviolet absorbing compounds which are liquid at room temperature are preferably used, singly or in combination.

The combined use of the present coupler and the ultraviolet absorber of formula (VIII) enables improvement in fastness of cyan dye, particularly to light. This ultraviolet absorber and a cyan coupler may be coemulsified.

The coated amount of the ultraviolet absorber should be sufficient to render the cyan dye fast to light. However, if the ultraviolet absorber is used in too large an amount, it can yellow the unexposed portion of the color photographic light-sensitive material (white background). Therefore, the coated amount of the ultraviolet absorber is generally in the range of $1\times10^{-4}$ to $2\times10^{-3}$ mol/m$^2$, and particularly preferably from $5\times10^{-4}$ to $1.5\times10^{-3}$ mol/m$^2$.

The combined use of the compound of formula (A-I) and/or (A-II) and a compound of formula (IX) below (included in formula (A-I) therewith can further improve the effects of the present invention.

Formula (IX) is represented by

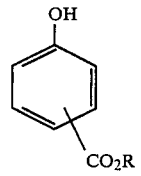

(IX)

wherein R represents an alkyl group or an aryl group which may be further substituted by substituents. The above-described alkyl group may be straight chain, branched or cyclic and preferably contains 8 or more carbon atoms.

Specific examples of compounds of formula (IX) are illustrated below.

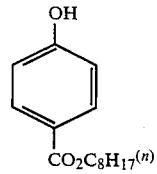

(A-53)

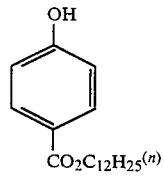

(A-54)

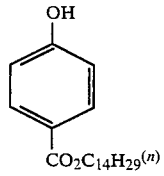

(A-55)

-continued (A-56)

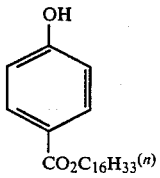

(A-57)

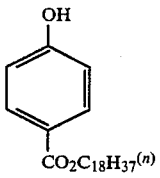

(A-58)

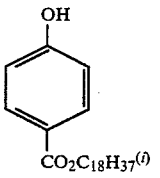

(A-59)

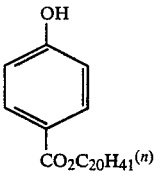

(A-60)

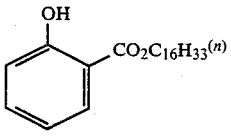

(A-61)

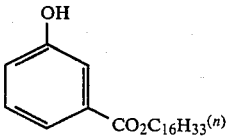

(A-62)

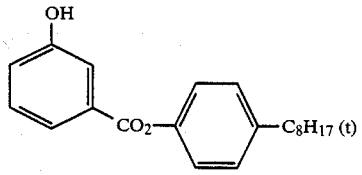

(A-63)

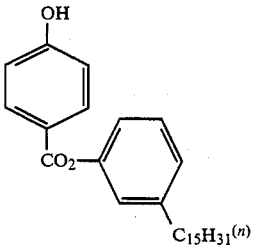

(A-64)

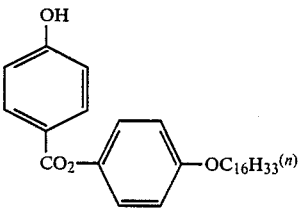

-continued (A-65)

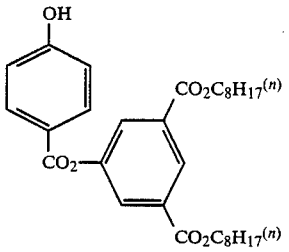

The silver halide emulsion layer in the present color photographic light-sensitive material can comprise various silver halides such as silver chloride, silver bromide, silver chlorobromide, silver iodobromide, and silver chloroiodobromide. Silver iodobromide containing from 2 to 20 mol% of silver iodide, and silver chlorobromide containing from 1 to 50 mol% of silver bromide are preferably used. The crystal shape, crystal structure, particle diameter, and particle diameter distribution of the particulate silver halide are not specifically limited. However, the crystal shape of the silver halide is preferably in a regular crystalline form, such as cubic, octahedral, or tetradecanedral. A plate particle having a thickness of 0.5 μm or less, a diameter of 0.6 μm or more, and an average aspect ratio of 5 or more, as described in *Research Disclosure,* RD No. 22534 (January, 1983) is preferably used.

The crystal structure may be uniform or such that the internal portion and the outer portion have different compositions. The crystal structure is preferably a layer structure. Alternatively, the crystal structure may be such that the silver halide is bonded by an epitaxial junction. Also, the particulate silver halide may consist of a mixture of particles of various crystal shapes. The particulate silver halide may be of the surface latent image type or of the internal latent image type.

The diameter of the particulate silver halide may be in the range of finely divided particles, i.e., 0.1 82 m or less, or large size, i.e., up to 3 μm, as determined by projected area. ("The Theory of the Photographic Process" chapter 2, The Silver Halide Grains, pages 36 to 43, Third Ed. (1966), C. E. Kenneth Mees and T. H. Janes, New York, The Macmillon Companey). The silver halide emulsion may be either a monodisperse emulsion having a narrow range of particle size or a polydisperse emulsion having a wide range of particle size. An emulsion having a fluctuation of 0.15 or less is preferably used.

The preparation of these silver halide particles can be accomplished by any known method commonly used in the art.

The above mentioned silver halide emulsion can be sensitized by a commonly used chemical sensitizing process such as sulfur sensitizing process, noble metal sensitizing process, or a combination thereof. Furthermore, the present silver halide emulsion can be processed with a sensitizing dye so that it can be rendered sensitive to a desired wavelength region.

As the support for the photographic material of the present invention, a transparent support such as polyethylene terephthalate and cellulose triacetate or a reflective support as described hereinafter can be used. Such a reflective support is preferably used. Examples of such a reflective support include baryta paper, polyethylene-coated paper, polypropylenic synthetic paper, transparent support such as glass plate combined with a reflective layer or reflective element, polyester film such as polyethylene terephthalate, cellulose triacetate, and cellulose nitrate, polyamide film, polycarbonate film, and polystyrene film. These supports can be appropriately selected depending on the purpose of use.

Alternatively, a support having a mirror-like surface or a surface with a second type diffused reflective power obtained by providing a thin metal film or metal powder-filled layer on a substrate as described in Japanese Patent Application Nos. 52788/85 and 168800/86 can be used.

As suitable color developing solution for processing the present light-sensitive material there may be preferably used an alkaline aqueous solution containing an aromatic primary amine color developing agent as a main component. Typical examples of such a color developing agent include 4-amino-N,N-diethylaniline, 3-methyl-4-N,N-diethylaniline, 4-amino-N-ethyl-N-β-hydroxydiethylaniline, 3-methyl-4-amino-N-β-hydroxyethylaniline, 3-methyl-4-amino-N-ethyl-β-methanesulfonamidoethylaniline, and 4-amino-3-methyl-N-ethyl-N-β-methoxyethylaniline.

Such a color developing solution may contain a pH buffer such as sulfite, carbonite, borate, and phosphate of alkali metal, development inhibitor such as bromide, iodide, and organic fog inhibitor, or fog inhibitor.

The photographic emulsion layer in the color developing solution is normally bleached. The bleach may be effected simultaneously with or separately of fixing. Examples of bleaching agents for the bleach process include compounds of polyvalent metals such as iron (III), cobalt (III), chromium (VI), and copper (II), peroxides, quinones, and nitroso compounds. Particularly useful among these compounds are potassium ferricyanate, iron (III) sodium ethylenediaminetetraacetate, and iron (III) ammonium ethylenediaminetetraacetate. Iron (III) ethylenediaminetetraacetate complex salts are useful both in a single bleach solution and a combined bleaching and fixing solution.

Washing may be effected after color development or blix. Color development may be effected at any temperature between 18° C. and 55° C., preferably 30° C. or above, particularly 35° C. or above. The development time is preferably as short as less than about 3 minutes, and particularly preferably is between 10 seconds and 2.5 minutes. Continuous development is preferably effected by refilling the processing solution at a rate of 330 cc to 160 cc, preferably 100 cc or less per square meter of area processed. The content of benzyl alcohol in the developing solution is preferably 2 ml/l or less, particularly preferably is 0.5 ml/l or less, and most preferably there is no benzyl alcohol present.

The blix may be effected at any temperature between 18° C. and 50° C., and preferably is 30° C. or higher. If the blix is effected at a temperature of 35° C. or higher, the processing time can be reduced to 1 minute or less and the amount of the solution to be refilled can be reduced. The time required for washing after color development or blix is normally 3 minutes or less. A stabilizing bath can be used so that washing can be substantially eliminated.

Developed dyes are subject to deterioration due to mold during storage as well as due to light, heat and moisture. Cyan dyes are particularly subject to deterioration due to mold and thus need the use of anti-mold agents. Specific examples of such mold agents include 2-thiazolylbenzimidazoles as described in Japanese Patent Application (OPI) No. 157244/82. Such anti-mold agents may be incorporated in the light-sensitive material or added during the development process. If the anti-mold agent is present with a light-sensitive material in the processing agent, it can be added at any processing step.

As described above, the combined use of the present cyan coupler and the compound of formula (A-I) or (A-II) gives an excellent effect that developed dyes are fast to heat, light and moisture, without being deposited in the photographic emulsion, an excellent color reproducibility can be obtained, and the white background is less subject to yellowing. The combined use of the present cyan coupler and the compound of formula (A-I) or (A-II) gives a high rate of forming a dye in a color developing solution and a high maximum color density, particularly in a color developing solution substantially free of benzyl alcohol. Furthermore, the combined use of the cyan coupler of formula (C-I) and the compound of formula (A-I) or (A-II) also gives an effect that even if a bleaching agent having a weak oxidizing power or a fatigued bleaching agent is used, it causes little or no density drop.

The present invention is further illustrated by the following examples, but the present invention should not be construed as being limited thereto.

EXAMPLE 1

13.0 g of a comparative cyan coupler (II-1) was dissolved in 10.4 ml of dibutyl phthalate and 30 ml of ethyl acetate. The solution was then added to 100 g of a gelatin solution containing 1 g of sodium dodecylbenzenesulfonate and 10 g of gelatin to obtain a fine emulsion dispersion.

The whole amount of the emulsion dispersion was added to 100 g of a silver chlorobromide emulsion (containing 50 mol% of Br and 6.5 g of Ag). 10 ml of a 2% sodium salt of 2,4-dihyroxy-6-chloro-s-triazine was added to the admixture shortly before it was coated on a support. The coating solution was then coated on a polyethylene-laminated paper support in an amount such that the amount of silver to be coated was 250 mg/m$^2$. A gelatin layer was provided on the top of the coated layer to prepare a specimen which is hereinafter referred to as Specimen 001.

Specimen 002 was prepared in the same manner as Specimen 001, except that 20 mol% of the present compound (A-1) was incorporated.

Specimens having compositions as shown in Table 1 below were similarly prepared.

These specimens were then wedgewise exposed to light of 1,000 C.M.S. (candle-meter-seconds) and processed with the following processing solutions.

| | |
|---|---|
| Developing Solution: | |
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfuric acid | 2 g |
| 4-Amino-3-methyl-N-β-(methanesulfonamido)ethylaniline.3/2 $H_2SO_4.H_2O$ | 4.5 g |
| Water to make | 1,000 ml |
| | pH 10.1 |
| Blix Solution: | |
| Ammonium thiosulfate (70 wt %) | 150 ml |
| $Na_2SO_3$ | 5 g |
| Na[Fe(EDTA)] | 40 g |

-continued

| | | |
|---|---|---|
| EDTA | | 4 g |
| Water to make | | 1,000 ml |
| | | pH 6.8 |
| Processing Step: | Temperature (°C.) | Time |
| Developing Solution | 33 | 3 min 30 sec |
| Blix Solution | 33 | 1 min 30 sec |
| Washing | 28–35 | 3 min |

These specimens on which dye images have been formed were measured for photographic properties. These specimens were then subjected to a discoloration test for 16 days by means of a xenon tester (luminous intensity: 200,000 lux) with Fuji Film's ultraviolet ray absorption filter for cutting light of wavelength of less than 400 nm interposed therebetween. The measurement was conducted by means of Fjui autographic densitometer. The measurement of discoloration was effected by measuring the change of density of the portion having an initial density before the test of 1.5.

Then, the same coated specimens were separately subjected to the same exposure and development as above. These specimens were allowed to stand at a high temperature of 100° C. for 16 days. The deterioration of dye images due to heat was then measured.

The results are shown in Table 1.

TABLE 1

| Specimen No. | Cyan Coupler | Added Amount (mol) | Discoloration Inhibitor | Added Amount (mol %) | Fastness to Heat (% cyan residue) (with respect to initial density) (%) | Fastness to Light (% cyan residue) (with respect to initial density) (%) | Remarks |
|---|---|---|---|---|---|---|---|
| 001 | (II-1)* | 0.026 | — | — | 11 | 63 | Comparison |
| 002 | " | " | Comparative Compound (a) | 20 | 12 | 64 | " |
| 003 | " | " | A-3 | " | 18 | 63 | " |
| 004 | " | " | A-12 | " | 15 | 63 | " |
| 005 | " | " | A-14 | " | 16 | 63 | " |
| 006 | " | " | A-21 | " | 17 | 64 | " |
| 007 | " | " | A-26 | " | 14 | 65 | " |
| 008 | " | " | A-50 | " | 14 | 63 | " |
| 009 | " | " | A-51 | " | 15 | 64 | " |
| 010 | " | " | A-34 | " | 19 | 68 | " |
| 011 | " | " | (UV-12) | " | 17 | 65 | " |
| 012 | (II-2)* | " | — | — | 29 | 56 | " |
| 013 | (II-2) | 0.026 | Comparative Compound (a) | 20 | 31 | 57 | Comparison |
| 014 | " | " | A-3 | " | 36 | 56 | " |
| 015 | " | " | A-12 | " | 35 | 55 | " |
| 016 | " | " | A-14 | " | 34 | 56 | " |
| 017 | " | " | A-21 | " | 35 | 56 | " |
| 018 | " | " | A-26 | " | 33 | 57 | " |
| 019 | " | " | A-50 | " | 34 | 56 | " |
| 020 | " | " | A-51 | " | 34 | 57 | " |
| 021 | " | " | A-34 | " | 37 | 59 | " |
| 022 | " | " | (UV-12) | " | 37 | 57 | " |
| 023 | (II-8)* | " | — | — | 68 | 22 | " |
| 024 | " | " | Comparative Compound (a) | " | 63 | 21 | " |
| 025 | " | " | A-3 | " | 72 | 22 | " |
| 026 | " | " | A-12 | " | 71 | 22 | " |
| 027 | (II-8) | 0.026 | A-14 | 20 | 71 | 22 | Comparison |
| 028 | " | " | A-21 | " | 72 | 23 | " |
| 029 | " | " | A-26 | " | 73 | 24 | " |
| 030 | " | " | A-50 | " | 71 | 22 | " |
| 031 | " | " | A-51 | " | 72 | 21 | " |
| 032 | " | " | A-34 | " | 75 | 27 | " |
| 033 | " | " | (UV-12) | " | 74 | 26 | " |
| 034 | (II-14)* | " | — | — | 65 | 21 | " |
| 035 | " | " | A-3 | 20 | 69 | 22 | " |
| 036 | " | " | A-21 | " | 70 | 23 | " |
| 037 | " | " | A-34 | " | 71 | 21 | " |
| 038 | " | " | A-42 | " | 69 | 24 | " |
| 039 | " | " | A-47 | " | 70 | 25 | " |
| 040 | (C-2) | " | — | — | 81 | 73 | " |
| 041 | (C-2) | 0.026 | Comparative Compound (a) | 20 | 82 | 73 | Comparison |
| 042 | " | " | A-3 | " | 96 | 91 | Invention |
| 043 | " | " | A-12 | " | 97 | 92 | " |
| 044 | " | " | A-14 | " | 95 | 90 | " |
| 045 | " | " | A-21 | " | 96 | 91 | " |
| 046 | " | " | A-26 | " | 96 | 90 | " |
| 047 | " | " | A-50 | " | 95 | 94 | " |
| 048 | " | " | A-51 | " | 95 | 96 | " |
| 049 | " | " | A-34 | " | 98 | 96 | " |
| 050 | " | " | (UV-12) | " | 96 | 75 | Comparison |
| 051 | (C-22) | " | — | — | 82 | 72 | " |
| 052 | " | " | A-7 | 20 | 95 | 90 | Invention |
| 053 | " | " | A-8 | " | 96 | 93 | " |
| 054 | " | " | A-16 | " | 96 | 94 | " |

TABLE 1-continued

| Specimen No. | Cyan Coupler | Added Amount (mol) | Discoloration Inhibitor | Added Amount (mol %) | Fastness to Heat (% cyan residue) (with respect to initial density) (%) | Fastness to Light (% cyan residue) (with respect to initial density) (%) | Remarks |
|---|---|---|---|---|---|---|---|
| 055 | (C-22) | 0.026 | A-22 | 20 | 95 | 94 | Invention |
| 056 | " | " | A-23 | " | 96 | 90 | " |
| 057 | " | " | A-25 | " | 95 | 91 | " |
| 058 | " | " | A-45 | " | 95 | 95 | " |
| 059 | " | " | A-47 | " | 95 | 96 | " |
| 060 | (C-24) | " | — | — | 80 | 74 | Comparison |
| 061 | " | " | A-1 | 20 | 94 | 93 | Invention |
| 062 | " | " | A-5 | " | 93 | 91 | " |
| 063 | " | " | A-9 | " | 95 | 92 | " |
| 064 | " | " | A-13 | " | 94 | 91 | " |
| 065 | " | " | A-19 | " | 95 | 93 | " |
| 066 | " | " | A-35 | " | 92 | 94 | " |
| 067 | " | " | A-38 | " | 91 | 95 | " |
| 068 | " | " | A-46 | " | 96 | 90 | " |
| 069 | (C-31) | 0.026 | — | — | 81 | 71 | Comparison |
| 070 | " | " | A-2 | 20 | 94 | 94 | Invention |
| 071 | " | " | A-5 | " | 93 | 95 | " |
| 072 | " | " | A-15 | " | 95 | 92 | " |
| 073 | " | " | A-17 | " | 93 | 94 | " |
| 074 | " | " | A-24 | " | 95 | 90 | " |
| 075 | " | " | A-34 | " | 94 | 95 | " |

Comparative Cyan Coupler
(II-1)* Coupler as described in Japanese Patent Application (OPI) No. 48535/79 and U.S. Pat. No. 4,268,593
(II-2)* Coupler as described in Japanese Patent Application (OPI) No. 232550/85
(II-8)* Coupler as described in Japanese Patent Application (OPI) Nos. 124340/84, 222853/85 and 229029/85
(II-14)* Coupler as described in Japanese Patent Application (OPI) No. 222852/85
*Compounds described as specific examples of formula (C-II)
Comparative Compound (a)

$$(C_{12}H_{25}SCH_2CH_2\overset{\overset{O}{\|}}{C}OCH_2\rightarrow_4C$$

(Compound as described in U.S. Pat. No. 4,540,658)

Table 1 shows that the use of the compound of formula (A-I) or (A-II) makes the comparative uncondensed ring cyan coupler more fast to heat and light. Table 1 also shows that the combined use of the condensed ring cyan coupler of formula (C-I) and the compound of formula (A-I) or (A-II) makes the comparative cyan coupler fast to heat and light to an extent much higher than expected for such a comparative cyan coupler.

A similar result was obtained, when cyan coupler of formulae (C-54), (C-55), (C-56) and (C-57) were used.

EXAMPLE 2

Specimens were prepared in the same manner as in Example 1 except that an emulsion dispersion having compositions shown in Table 2 prepared in the same manner as in Example 1 was added to 100 g of a pure silver chloride emulsion (containing 6.5 g of Ag).

These specimens were then wedgewise exposed to light of 3,000 C.M.S. and processed with the following processing solutions using the following processing steps.

| Color Developing Solution: | |
|---|---|
| Water | 800 ml |
| Diethylenetriaminepentaacetic acid | 3.0 g |
| Potassium bromide | 0.3 g |
| Potassium carbonate | 30 g |
| N-Ethyl-N-(β-methanesulfonamidoethyl)-3-methyl-4-aminoaniline sulfate | 5.5 g |
| Sodium sulfite | 1.7 g |
| Hydroxylamine sulfate | 3.0 g |
| Fluorescent whitening agent (4,4'-diaminostilbene) | 1.0 g |
| Water to make | 1,000 ml |
| HOH to make | pH 10.20 |

Blix Solution:
The same as used in Example 1.

Processing Steps:

| Step | Time | Temperature |
|---|---|---|
| Color Development | 45 min | 35° C. |
| Blix | " | 35° C. |
| Washing | 60 sec | 35° C. |

The developed dye images were measured for photographic properties. These specimens were then subjected to the same light fastness test as in Example 1. The same specimens were separately subjected to the same heat fastness test as in Example 1. The results are shown in Table 2.

TABLE 2

| Specimen No. | Cyan Coupler | Added Amount (mol) | Discoloration Inhibitor | Added Amount Based on Cyan Coupler (mol %) | Heat Fastness Test (% cyan residue) (with respect to initial density of 1.5) (%) | Light Fastness Test (% cyan residue) (with respect to initial density of 1.5) (%) | Remarks |
|---|---|---|---|---|---|---|---|
| 100 | (II-6) | 0.026 | — | — | 30 | 55 | Comparison |
| 101 | " | " | A-47 | 20 | 35 | 56 | " |
| 102 | " | " | A-47 | " | 39 | 55 | " |
| | | | (UV-5) | " | | | |
| 103 | " | " | A-47 | " | 38 | 55 | " |
| | | | A-56 | " | | | |
| 104 | (II-10) | " | — | — | 66 | 21 | " |
| 105 | " | " | A-34 | 20 | 69 | 22 | " |
| 106 | " | " | A-34 | " | 72 | 23 | " |
| | | | (UV-12) | " | | | |
| 107 | " | " | A-34 | " | 71 | 21 | " |
| | | | A-57 | " | | | |
| 108 | (C-7) | " | — | — | 81 | 75 | " |
| 109 | " | " | A-34 | 20 | 92 | 91 | Invention |
| 110 | " | " | A-34 | " | 97 | 98 | " |
| | | | (UV-1) | " | | | |
| 111 | (C-7) | 0.026 | A-34 | 20 | 98 | 97 | Invention |
| | | | A-63 | " | | | |
| 112 | (C-12) | " | — | — | 83 | 71 | Comparison |
| 113 | " | " | A-21 | 20 | 91 | 90 | Invention |
| 114 | " | " | A-21 | " | 97 | 96 | " |
| | | | (UV-3) | " | | | |
| 115 | " | " | A-21 | " | 97 | 95 | " |
| | | | A-56 | " | | | |
| 116 | (C-23) | " | — | — | 80 | 73 | Comparison |
| 117 | " | " | A-47 | 20 | 92 | 91 | " |
| 118 | " | " | A-47 | " | 96 | 97 | " |
| | | | (UV-4) | " | | | |
| 119 | " | " | A-47 | " | 97 | 96 | " |
| | | | A-65 | " | | | |

Table 2 shows that the combined use of the compound of formula (A-I) or (A-II) and the present coupler with the compound of formula (VIII) or (IX) further improves the fastness to heat and light.

EXAMPLE 3

Various light-sensitive materials A to J were prepared by coating first (bottom) to seventh (top) layers as shown in Tables 3 and 5 on a paper coated with polyethylene on both sides thereof.

TABLE 3

| | |
|---|---|
| Seventh Layer: Protective Layer | |
| Gelatin | 1.2 g/m$^2$ |
| Sixth Layer: Ultraviolet Absorbing Intermediate Layer | |
| Ultraviolet absorber (UV-1/UV-7/UV-3 = 1/1/1*) | 0.20 g/m$^2$ |
| Solvent for ultraviolet absorber (DBP) | 0.20 g/m$^2$ |
| Gelatin | 0.15 g/m$^2$ |
| Fifth Layer: Red-Sensitive Layer | |
| Silver chloride emulsion | 0.20 g/m$^2$ |
| Cyan coupler (see Table 5) | 0.39 × 10$^{-3}$ mol/m$^2$ |
| Discoloration inhibitor (see Table 5) | 30 mol %*/m$^2$ |
| Coupler solvent (TNP/DBP) | 0.24/0.20 g/m$^2$ |
| Gelatin | 0.9 g |
| Fourth Layer: Ultraviolet Absorbing Intermediate Layer | |
| Ultraviolet absorber (UV-20/UV-5/UV-4) | 0.06/0.25/0.25 g/m$^2$ |
| Solvent for ultraviolet absorber | 0.20 g/m$^2$ |
| Gelatin | 0.90 g/m$^2$ |
| Third Layer: Green-Sensitive Layer | |
| Silver chloride emulsion | 0.15 g/m$^2$ |
| Magenta coupler (see Table 5) | 0.36 × 10$^{-3}$ mol/m$^2$ |
| Discoloration inhibitor (see Table 5) | 0.17 × 10$^{-3}$ mol %*/m$^2$ |
| Solvent for discoloration inhibitor (TNP) | 0.44 g/m$^2$ |
| Gelatin | 1.35 g/m$^2$ |
| Second Layer: Intermediate Layer | |
| Gelatin | 0.9 g/m$^2$ |
| Di-t-octylhydroquinone | 0.05 g/m$^2$ |
| Solvent (DBP) | 0.10 g/m$^2$ |
| First Layer: Blue-Sensitive Layer | |
| Silver chloride emulsion | 0.3 g/m$^2$ |
| Yellow coupler (see Table 5) | 1.0 × 10$^{-3}$ mol/m$^2$ |
| Discoloration inhibitor (see Table 5) | 0.15 g/m$^2$ |
| Solvent for discoloration inhibitor (TNP) | 0.15 g/m$^2$ |
| Gelatin | 1.20 g/m$^2$ |
| Support: | |
| Polyethylene-laminated paper (polyethylene on the first layer side contains a white pigment) | |

*Used amount based on coupler.
DBP represents dibutyl phthalate.
TNP represents tri(n-nonyl) phosphate As spectral sensitizers for the various emulsion layers, the following dyes were used.

Blue-Sensitizing Dye

-continued
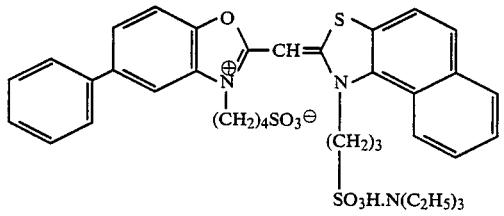
($7.0 \times 10^{-4}$ mol added per mol of silver halide)
Green-Sensitizing Dye
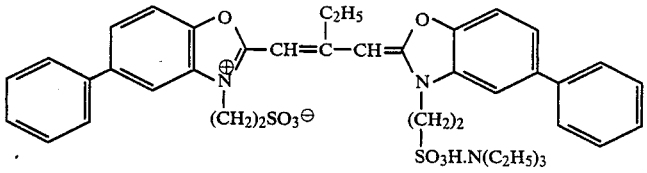
($4.0 \times 10^{-4}$ mol added per mol of silver halide)
Red-Sensitizing Dye
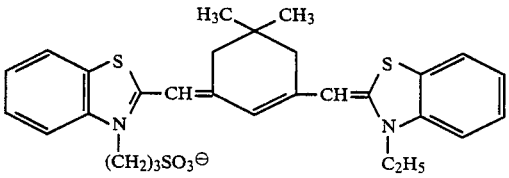
($1.0 \times 10^{-4}$ mol added per mol of silver halide)
As anti-irradiation dyes for the various emulsion layers, the following dyes were used.
Green-Sensitive Emulsion Layer
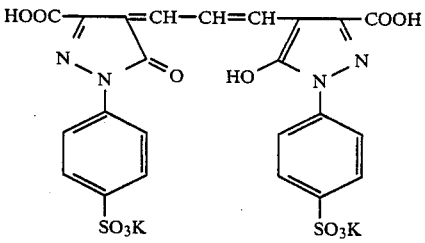
Red-Sensitive Emulsion Layer
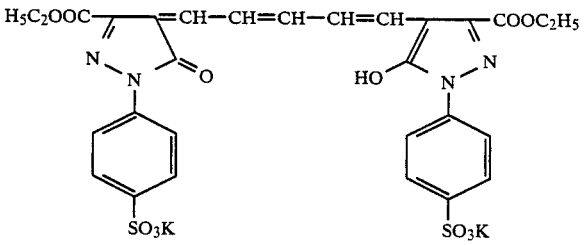
(a) Yellow Coupler -continued
(a-1)
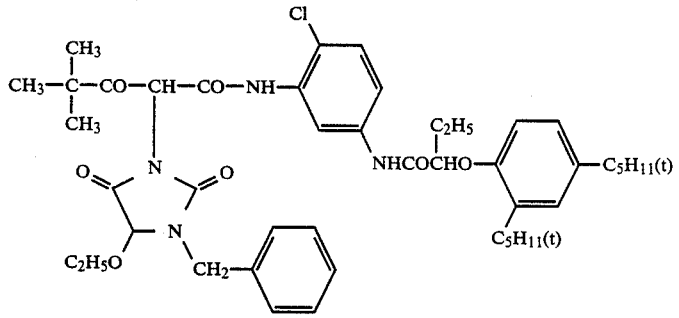
(a-2)
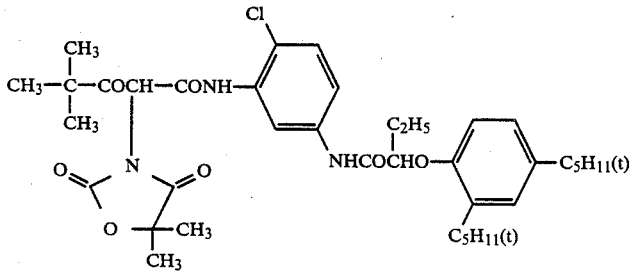
(a-3)
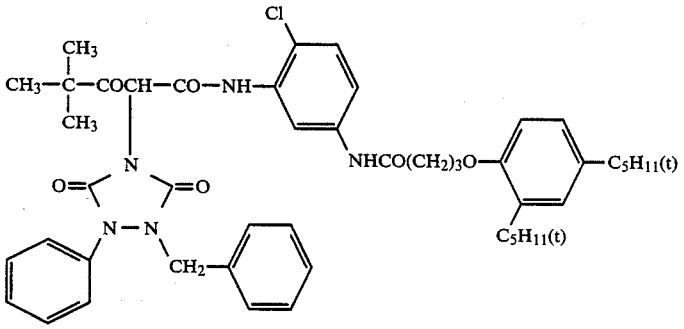
(b) Magenta Coupler
(b-1)
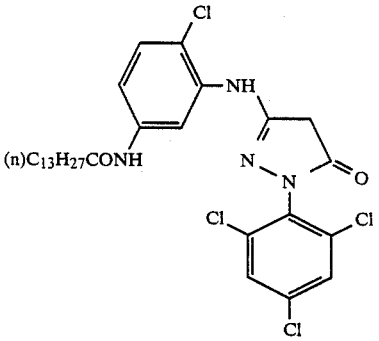
(b-2)
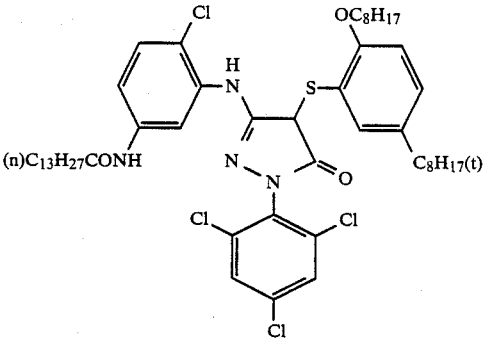

-continued

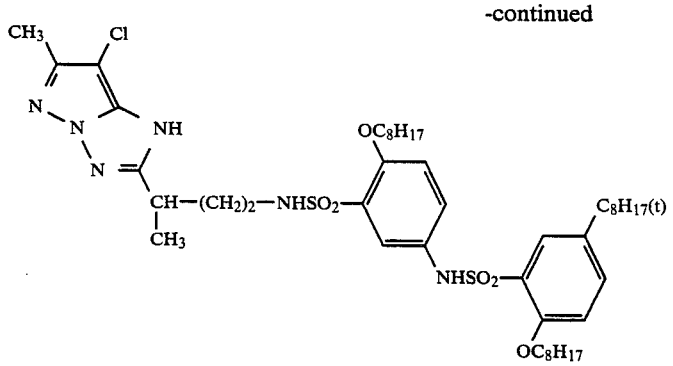

(b-3)

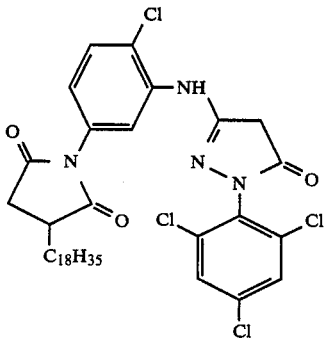

(b-4)

Compound (X)

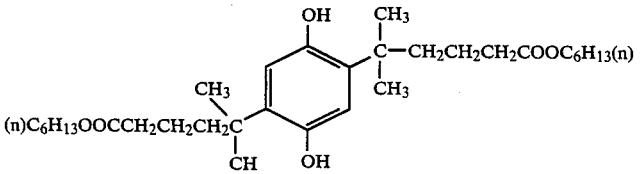

On the other hand, Specimens K and L were prepared by coating first (bottom) layer to seventh (top) layer having compositions shown in Table 4 on a double polyethylene-laminated paper which had been processed by corona discharge.

The coating solution for the above first layer was prepared as follows. A mixture of 200 g of a yellow coupler, 10 g of a high boiling point solvent (c), 5 g of a high boiling solvent (d), and 600 ml of ethyl acetate as an auxiliary solvent was heated to a temperature of 60° C. so that dissolution was accomplished. The solution was mixed with 3,300 ml of a 5% aqueous solution of gelatin containing 330 ml of a 5% aqueous solution of Alkanol B (alkylnaphthalene sulfonate manufactured by Du Pont). The mixture was then subjected to emulsification by means of a colloid mill to prepare a coupler dispersion. Ethyl acetate was removed from the dispersion under reduced pressure. The dispersion was added to 1,400 g of an emulsion (containing 96.7 g of Ag and 17.0 g of gelatin) comprising a sensitizing dye for the blue-sensitive emulsion layer and 1-methyl-2-mercapto-5-acetylamino-1,3,4-triazole. 2,600 g of a 10% aqueous solution of gelatin was added to the admixture to prepare the desired coating solution.

The coating solutions for the second to seventh layers were prepared in accordance with the above process.

TABLE 4

| | |
|---|---|
| Seventh Layer: Protective Layer | |
| Gelatin | 600 mg/m$^2$ |
| Sixth Layer: Ultraviolet Absorbing Layer | |

TABLE 4-continued

| | |
|---|---|
| Ultraviolet absorber (*a) | 260 mg/m$^2$ |
| Ultraviolet absorber (*b) | 70 mg/m$^2$ |
| Solvent (*c) | 300 mg/m$^2$ |
| Solvent (*d) | 100 mg/m$^2$ |
| Gelatin | 700 mg/m$^2$ |
| Fifth Layer: Red-Sensitive Layer | |
| Silver chlorobromide emulsion | 210 mg Ag/m$^2$ |
| Cyan coupler (see Table 5) | total 380 mg/m$^2$ |
| Discoloration inhibitor (see Table 5) | 200 mg/m$^2$ |
| Solvent (*c) | 160 mg/m$^2$ |
| Solvent (*d) | 100 mg/m$^2$ |
| Gelatin | 1,800 mg/m$^2$ |
| Fourth Layer: Color Stain Inhibiting Layer | |
| Color stain inhibitor (*f) | 65 mg/m$^2$ |
| Ultraviolet absorber (*a) | 450 mg/m$^2$ |
| Ultraviolet absorber (*b) | 230 mg/m$^2$ |
| Solvent (*c) | 50 mg/m$^2$ |
| Solvent (*d) | 50 mg/m$^2$ |
| Gelatin | 1,700 mg/m$^2$ |
| Third Layer: Green-Sensitive Layer | |
| Silver chlorobromide emulsion | 305 mg Ag/m$^2$ |
| Magenta coupler (b-4) | 670 mg/m$^2$ |
| Color stain inhibitor (*g) | 150 mg/m$^2$ |
| Color stain inhibitor (*h) | 10 mg/m$^2$ |
| Solvent (*c) | 200 mg/m$^2$ |
| Solvent (*d) | 10 mg/m$^2$ |
| Gelatin | 1,400 mg/m$^2$ |
| Second Layer: Color Stain Inhibiting Layer | |
| Silver chlorobromide emulsion (unripened, particle diameter: 0.05 μm) | 10 mg Ag/m$^2$ |
| Color stain inhibitor (*f) | 55 mg/m$^2$ |
| Solvent (*c) | 30 mg/m$^2$ |
| Solvent (*d) | 15 mg/m$^2$ |
| Gelatin | 800 mg/m$^2$ |

TABLE 4-continued

| First Layer: Blue-Sensitive Layer | |
|---|---|
| Silver chlorobromide emulsion | 290 mg Ag/m$^2$ |
| Yellow coupler (a-3) | 600 mg/m$^2$ |
| Discoloration inhibitor (*e) | 280 mg/m$^2$ |
| Solvent (*c) | 30 mg/m$^2$ |
| Solvent (*d) | 15 mg/m$^2$ |
| Gelatin | 1,800 mg/m$^2$ |
| Support: | |
| Double polyethylene-laminated paper | |

(*a) 2-(2-Hydroxy-3,5-di-tert-amylphenyl)benzotriazole
(*b) 2-(2-Hydroxy-3,5-di-tert-butylphenyl)benzotriazole
(*c) Di(2-ethylhexyl)phthalate
(*d) Dibutyl phthalate
(*e) 2,5-Di-tert-amylphenyl-3,5-di-tert-butylhydroxy-benzoate
(*f) 2,5-Di-tert-octylhydroquinone
(*g) 1,4-Di-tert-amyl-2,5-dioctyloxybenzene
(*h) 2,2'-Methylbis(4-methyl-6-tert-butylphenol)

As the sensitizing dyes for the various emulsion layers there were used the following compounds:

Blue-Sensitive Emulsion Layer:

Anhydro-5-methoxy-5'-methyl-3,3'-disulfopropylselenacyaninehydroxide

Green-Sensitive Emulsion Layer:

Same as the sensitizing dye for the green-sensitive layer used in Specimens A to J Red-Sensitive Emulsion Layer:

3,3'-Diethyl-5-methoxy-9,9'-(2,2-dimethyl-1,3-propano)thiadicarbocyanine iodide.

As the stabilizer for the various emulsion layers, 1-methyl-2-mercapto-5-acetylamino-1,3,4-triazole was used.

As the anti-irradiation dye for the green-sensitive layer, the same compound as used in Specimens A to J was used. As the anti-irradiation dye for the red-sensitive layer, N,N'-(4,8-dihydroxy-9,10-dioxo-3,7-disulfonateanthracene-1,5-diil)bis(aminomethanesulfonate)-tetrasodium salt was used.

As the film hardener, 1,2-bis(vinylsulfonyl) ethane was used.

Specimens A to L thus prepared were exposed to light through an optical wedge, processed in the same manner as in Example 2, measured for cyan reflection density by Fuji's autograph densitometer, and subjected to a 30-day discoloration test by means of a fluorescent light tester (luminous intensity: 150,000 lux).

On the other hand, the same specimens A to L were stored at a temperature of 80° C. and 10% to 15% RH in a dark room for 30 days, and measured for cyan reflection density.

The results are shown in Table 5.

TABLE 5

| Light-Sensitive Material No. | Yellow Coupler | Discoloration Inhibitior | Magenta Coupler | Discoloration Inhibitor | Cyan Coupler | Discoloration Inhibitor | Fastness to Heat (% cyan residue) (with respect to initial density of 1.5) (%) | Fastness to Light (% cyan residue) (with respect to initial density of 1.5) (%) | Remarks |
|---|---|---|---|---|---|---|---|---|---|
| A | (a-1) | A-34 | (b-1) | Compound(X)*1 A-23 A-52 | (II-1) | A-21 | 77 | 76 | Comparison |
| B | " | " | " | " | " | A-34 | 81 | 79 | " |
| C | " | " | " | " | (C-2) | A-1 | 92 | 91 | Invention |
| D | " | " | (b-2) | " | " | A-2 | 91 | 89 | " |
| E | " | " | (b-3) | A-52 | " | A-34 | 93 | 90 | " |
| F | " | " | " | " | (C-2)*2 | A-47 | 92 | 95 | " |
| G | " | " | " | " | (C-22) | A-5 | 93 | 89 | " |
| H | (a-2) | " | " | " | " | A-8 | 92 | 91 | " |
| I | (a-1) | " | " | " | " | A-23 | 91 | 92 | " |
| J | (a-2) | " | " | " | " | A-47*2 | 95 | 96 | " |
| K | (a-3) | (shown in Table 4) | (b-4) | (shown in Table 4) | (II-10) | A-21 | 87 | 65 | Comparison |
| L | " | | " | | " | A-34 | 84 | 67 | " |

Table 5 shows that the combined use of the coupler of formula (C-I) and at least one compound of formula (A-I) or (A-II) drastically improves the fastness of multilayer system as well as single layer system to heat and light. It is also understood that this effect depends little on the constitution of other layers.

The similar effect can be obtained also when the present discoloration inhibitors A-4, A-6, A-9, A-10, A-11, A-18, A-20, A-27, A-28, A-29, A-30, A-31, A-32, A-33, A-36, A-37, A-39, A-40, A-41, A-43, A-44, A-48 and A-49 are used.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon a silver halide emulsion layer containing at least one coupler represented by formula (C-I) and at least one compound represented by formula (A-II) which are co-emulsified with each other

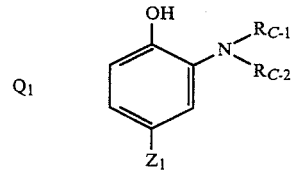

(C-I)

wherein $Q_1$ represents an atomic group containing at least one nitrogen atom required to form a 5- or more membered nitrogen-containing heterocyclic ring together with the carbon atoms to which it is bonded, said atomic group being represented by the formula —$NR_{C-3}CO$—$Q_1$—, wherein $Q_1$ is selected from the group consisting of a divalent amino group, an ether group, a thioether group, an alkylene group, a vinylene group, an imino group, a sulfonyl group, a carbonyl group, an arylene group, a divalent heterocyclic group, and combinations thereof, and $R_{C-3}$ represents a hydrogen atom or an alkyl group; $Z_1$ represents a hydrogen atom or a coupling-off group; $R_{C-1}$ represents an acyl group or a sulfonyl group; and $R_{C-2}$ represents a hydrogen atom or a $C_{1-8}$ aliphatic group; or the substituents for $R_{C-1}$, $R_{C-2}$, $Z_1$, or $Q_1$ form a dimeric or polymeric coupler

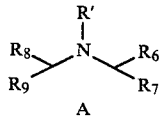

(A-II)

wherein R' represents a hydrogen atom, an aliphatic group, an acyl group, a sulfonyl group, a sulfinyl group, an oxyradical group, or a hydroxyl group; A represents a non-metallic atomic group forming a 5-, 6-, or 7-membered ring; and $R_6$, $R_7$, $R_8$, and $R_9$ each represents a hydrogen atom or an alkyl group, or the substituents represented by $R_6$ and $R_7$, $R_8$ and $R_9$, or R' and $R_6$ are bonded to each other to form a 5-, 6-, or 7-membered ring.

2. A silver halide color photographic material as in claim 1, wherein $R_{C-1}$ represents a group represented by the formula —CO—$X_1$—$R_{C-4}$ or —$SO_2$—$X_1$—$R_{C-4}$, wherein $X_1$ represents —O—,$NR_{C-5}$— or a chemical bond, wherein $R_{C-4}$ represents $C_{1-32}$ aliphatic group and $R_{C-5}$ represents a hydrogen atom or $C_{1-8}$ aliphatic group.

3. A silver halide color photographic material as in claim 1, wherein $Z_1$ represents a hydrogen atom, halogen atom, aryloxy group, or alkoxy group;

$Q_1$ represents an atomic group completing formation of a 5- to 8-membered ring, $R_{C-1}$ is a group represented by the formula —CO—$X_1$—$R_{C-4}$, and $R_{C-2}$ is a hydrogen atom.

4. A silver halide color photographic material as in claim 1, wherein said coupler represented by formula (C-I) is incorporated in a silver halide emulsion layer constituting a light-sensitive layer in an amount of from 0.1 to 1.0 mol/mol Ag.

5. A silver halide color photographic material as in claim 1, wherein said coupler represented by formula (C-I) is incorporated in a silver halide emulsion layer constituting a light-sensitive layer in an amount of from 0.1 to 0.5 mol/mol Ag.

6. A silver halide color photographic material as in claim 3, wherein said coupler represented by formula (C-I) is incorporated in a silver halide emulsion layer constituting a light-sensitive layer in an amount of from 0.1 to 0.5 mol/mol Ag.

7. A silver halide color photographic material as in claim 4, wherein the relative amount of compound of formula (A-II) with respect to the coupler of formula (C-I) is from 10 to 150 mol%.

8. A silver halide color photographic material as in claim 5, wherein the relative amount of compound of formula (A-II) with respect to the coupler of formula (C-I) is from 10 to 150 mol%.

9. A silver halide color photographic material as in claim 6, wherein the relative amount of compound of formula (A-II) with respect to the coupler of formula (C-I) is from 10 to 150 mol%.

10. A silver halide color photographic material as in claim 6, wherein the relative amount of compound of formula (A-II) with respect to the coupler of formula (C-I) is from 10 to 150 mol%.

11. A silver halide color photographic material as in claim 1, further comprising another silver halide emulsion layer containing at least one pyrazoloazole type magenta coupler.

12. A silver halide color photographic material as in claim 11, wherein pyrazoloazole type magenta coupler is pyrazolo[5,1-C][1,2,4]triazoles, imidazo[1,2-b]pyrazoles or pyrazolo[1,5-b][1,2,4]triazoles.

13. A silver halide color photographic material as in claim 1, further comprising at least a compound of formula (VIII) and/or at least a compound of formula (IX)

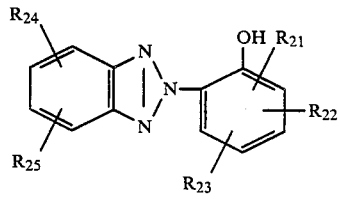

(VIII)

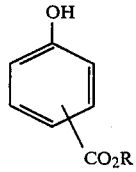

(IX)

wherein $R_{21}$, $R_{22}$, $R_{23}$, $R_{24}$ and $R_{25}$ which may be the same or different, each represents a hydrogen atom or a substituent, or $R_{24}$ and $R_{25}$ combine with each other to form a 5- or 6-membered aromatic ring containing carbon atoms; and R represents an alkyl group or aryl group which may be further substituted by substituents.

14. A silver halide color photographic material as in claim 1, wherein the cyan coupler represents a compound of formula (C-1a) or (C-1b)

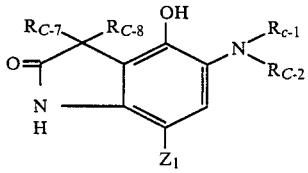

(C-1a)

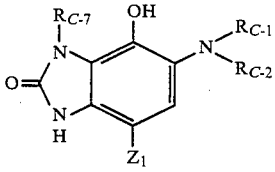

(C-1b)

wherein $R_{C-7}$, $R_{C-8}$ each represents an aliphatic group or connects each other to form a ring; $R_{C-1}$ and $R_{C-2}$ have the same meanings as $R_1$ and $R_2$ in formula (C-1), respectively; and $Z_1$ is as defined in formula (C-1).

15. A silver halide color photographic material as in claim 11, wherein the cyan coupler represents a compound of formula (C-1a) for (C-1b)

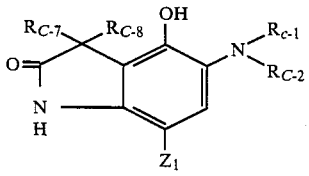

(C-1a)

-continued

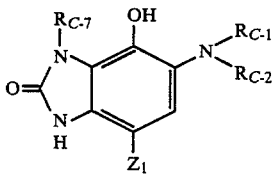

(C-1b)

wherein $R_{C-7}$, $R_{C-8}$ each represents an aliphatic group or connects each other to form a ring; $R_{C-1}$ and $R_{C-2}$ have the same meanings as $R_1$ and $R_2$ in formula (C-1), respectively; and $Z_1$ is as defined in formula (C-1).

16. A silver halide color photographic material as in claim 13, wherein the cyan coupler represents a compound of formula (C-1a) or (C-1b)

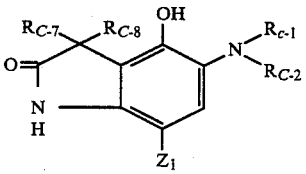

(C-1a)

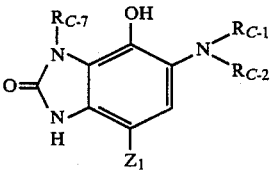

(C-1b)

wherein $R_{C-7}$, $R_{C-8}$ each represents an aliphatic group or connects each other to form a ring; $R_{C-1}$ and $R_{C-2}$ have the same meanings as $R_1$ and $R_2$ in formula (C-1), respectively; and $Z_1$ is as defined in formula (C-1).

17. A silver halide color photographic material as in claim 1, wherein A in formula (A-II) represents an atomic group which is required to form a 6-membered ring.

18. A silver halide color photographic material as in claim 1, wherein A in formula (A-II) represents an atomic group which is required to form a piperidine ring.

19. A silver halide color photographic material as in claim 11, wherein A in formula (A-II) represents an atomic group which is required to form a 6-membered ring.

20. A silver halide color photographic material as in claim 13, wherein A in formula (A-II) represents an atomic group which is required to form a piperidine ring.

21. A silver halide color photographic material as in claim 11, further comprising at least a compound of formula (VIII) and/or at least a compound of formula (IX)

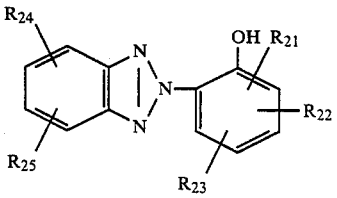

(VIII)

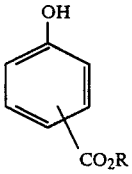

(IX)

wherein $R_{21}$, $R_{22}$, $R_{23}$, $R_{24}$ and $R_{25}$ which may be the same or different, each represents a hydrogen atom or a substituent, or $R_{24}$ and $R_{25}$ combine with each other to form a 5- or 6-membered aromatic ring containing carbon atoms; and R represents an alkyl group or aryl group which may be further substituted by substituents.

* * * * *